US012398979B2

(12) United States Patent
Reynoso et al.

(10) Patent No.: US 12,398,979 B2
(45) Date of Patent: Aug. 26, 2025

(54) ACTIVE SHOOTER PROTECTION SYSTEM UTILIZING A BALLISTIC BLANKET AND AN INTEGRATED LOCKING SYSTEM

(71) Applicants: Florenzo Reynoso, Santa Fe, NM (US); Zebulun Evridge, Santa Fe, NM (US)

(72) Inventors: Florenzo Reynoso, Santa Fe, NM (US); Zebulun Evridge, Santa Fe, NM (US)

( * ) Notice: Subject to any disclaimer, the term of this patent is extended or adjusted under 35 U.S.C. 154(b) by 0 days.

(21) Appl. No.: 17/945,389

(22) Filed: Sep. 15, 2022

(65) Prior Publication Data

US 2024/0093969 A1 Mar. 21, 2024

(51) Int. Cl.
*F41H 5/00* (2006.01)
*F41H 5/013* (2006.01)
*F41H 5/02* (2006.01)

(52) U.S. Cl.
CPC ..... *F41H 5/023* (2013.01); *F41H 5/013* (2013.01)

(58) Field of Classification Search
CPC ..... F41H 5/00; F41H 5/023; F41H 5/013
USPC ..... 109/49.5
See application file for complete search history.

(56) References Cited

U.S. PATENT DOCUMENTS 1,534,664 A * 4/1925 Saunders ..... E04F 10/0614 160/72
1,649,996 A * 11/1927 Toth ..... F41H 5/08 2/2.5
1,988,666 A * 1/1935 Sandell ..... E04F 10/0659 160/310
2,008,412 A * 7/1935 Bovee ..... A47B 21/045 312/208.3
2,276,550 A * 3/1942 Skyum ..... E04F 10/0614 160/907
3,022,808 A * 2/1962 Silver ..... B60J 11/00 D25/56
3,259,173 A * 7/1966 Mannin ..... B41J 29/13 160/238
3,454,075 A * 7/1969 Weinstein ..... B41J 29/13 312/208.3
3,893,368 A * 7/1975 Wales, Jr. ..... F41H 5/007 250/221
4,856,436 A * 8/1989 Campbell ..... E04H 1/1238 109/38
5,377,577 A * 1/1995 Bounkong ..... F41H 5/08 2/2.5
5,554,816 A * 9/1996 Skaggs ..... F41H 9/10 89/36.02
6,161,462 A * 12/2000 Michaelson ..... F41H 5/16 89/36.01

(Continued)

*Primary Examiner* — Suzanne L Barrett
(74) *Attorney, Agent, or Firm* — The Rapacke Law Group, P.A.; Andrew S. Rapacke

(57) ABSTRACT

An Active Shooter Protection System (ASPS), comprising a variety of gravity-operated mechanisms for deploying one or more ballistic sheets, panels, or blankets of woven ultra-high-strength polymeric fiber (e.g., Kevlar™) directly in front of a door, such as in a school room. The deployment of a ballistic blanket is initiated by pulling down on a pull box, which activates a release that lowers down one or more segments of the ballistic blanket that is stored above a top of a door plate. The ASPS system includes means for securely locking the door shut (in addition to a dead bolt lock). The ballistic panels can include optional ceramic inserts for greater protection from high-power AR-15 rifles.

13 Claims, 29 Drawing Sheets

(56) References Cited

U.S. PATENT DOCUMENTS

| | | | | |
|---|---|---|---|---|
| 6,581,505 | B1 * | 6/2003 | Levell | E06C 1/52 89/36.01 |
| 7,730,925 | B1 * | 6/2010 | Pereira | E06B 9/262 160/348 |
| 7,980,166 | B1 * | 7/2011 | Fuqua | F41H 5/24 86/50 |
| 8,418,595 | B1 * | 4/2013 | Saucedo | F41H 5/08 89/36.01 |
| 8,646,372 | B1 * | 2/2014 | Lee | F41H 5/08 89/36.07 |
| 9,568,283 | B2 * | 2/2017 | Brill | F41H 5/007 |
| 10,151,566 | B2 * | 12/2018 | Adrain | F41H 5/0457 |
| 10,801,815 | B2 * | 10/2020 | Adrain | F41H 5/26 |
| 11,561,070 | B2 * | 1/2023 | Adrain | E06B 9/386 |
| 2015/0059990 | A1 * | 3/2015 | Adrain | E06B 9/56 89/36.02 |
| 2016/0061569 | A1 * | 3/2016 | Fernandez | F41H 5/08 89/36.02 |
| 2020/0232767 | A1 * | 7/2020 | Riden | G08B 21/10 |
| 2020/0256647 | A1 * | 8/2020 | Howell | F41H 5/0407 |
| 2022/0390211 | A1 * | 12/2022 | Adrain | E06B 9/382 |
| 2023/0152062 | A1 * | 5/2023 | Riden | E06B 9/17046 89/36.01 |

* cited by examiner

ACTIVE SHOOTER PROTECTION SYSTEM UTILIZING A BALLISTIC BLANKET AND AN INTEGRATED LOCKING SYSTEM

TECHNICAL FIELD

Embodiments of the invention relate to a ballistic door protection system for protecting classrooms in schools from an active shooter.

BACKGROUND

Most existing systems for protecting students in a school classroom from an active shooter all have some means for preventing the door from opening. Examples include deadbolt locks, and removable/insertable wedges, chains, or plates of metal that securely lock the bottom or the side of the door. For commercial doors, roll-down plates of steel sub-panels are commonly used, which are driven by a long circular chain or are motorized. However, these system can take many minutes to be deployed, and full deployment might therefore be too late in an active shooter situation. Other mechanisms include ballistic doors and shutters that are expensive and not easily portable for users to take with them in case they have to move. Also, shutters are slower to deploy and are bulky to have in most places. Most home/business/school owners would rather keep their current doors, rather than replacing them with ballistic doors, which can cost up to $1000 per door.

SUMMARY OF THE INVENTION

The Active Shooter Protection System (ASPS) is a system, device, and method that could be quickly deployed in the event of an active shooter situation. It adds protection to any standard door situated above the door plate. It has an integrated locking system and a ballistic shield that can deploy downward to the floor to cover the door and prevent entry and will stop hand gun and most rifle caliber ammunition. These embodiments can prevent a doorway from becoming a soft target for an active shooter intent on causing harm to the public. The Active Shooter Protection Systems (ASPSs) comprise a variety of gravity-operated mechanisms for deploying one or more ballistic sheets, panels, or blankets of woven ultra-high-strength polymeric fibers (e.g., Kevlar™) directly in front of a door, such as in a school room. The deployment of a ballistic blanket can be initiated by pulling down on a pull box, which activates a mechanical release that lowers down one or more sections of a ballistic blanket that is stored above a top of a door plate. The ASPS systems include means for securely locking the door shut in addition to a dead bolt lock, if any. The ballistic panels can include optional ceramic or ceramic/metal composite inserts for greater protection from high-power AR-15 type of rifles. The Active Shooter Protection System can be coupled or attached above the door plate on any standard doors. A switch is attached on the side of the door and, once pulled, it releases the foldable blanket and activates a door-locking mechanism that will secure the door and provide safety from handgun and most rifle caliber ammunition. The advantages of the Active Shooter Protection Systems is that they are affordable and portable. They do not require any power (electricity or fuel) to deploy. Within seconds, they can be easily fully deployed. They can be used and deployed by any user, even a young child.

BRIEF DESCRIPTION OF THE DRAWINGS

A more complete understanding of the embodiments, and the attendant advantages and features thereof, will be more readily understood by references to the following detailed description, when considered in conjunction with the accompanying drawings, wherein.

DETAILED DESCRIPTION OF THE INVENTION

Figure 1:
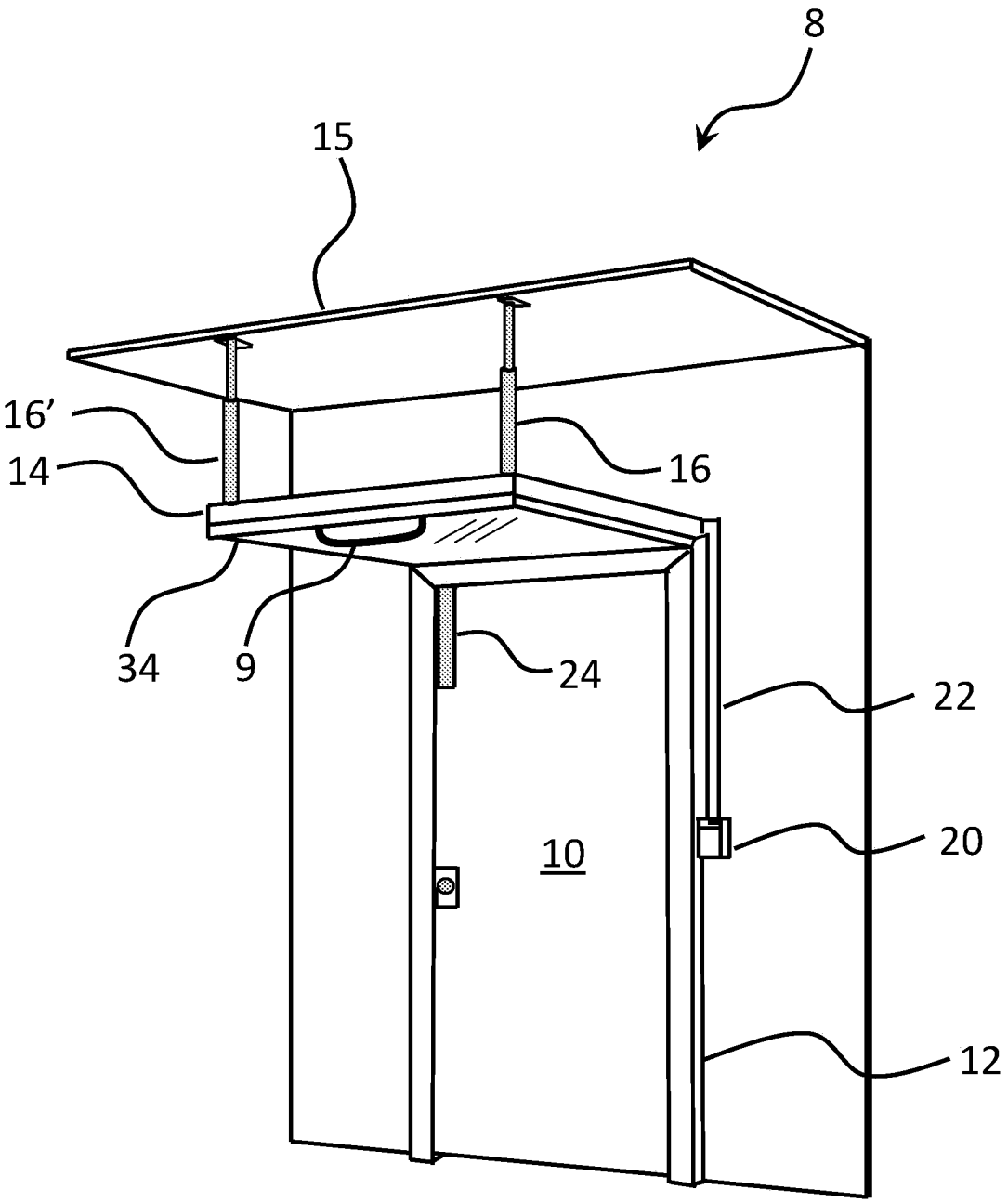
FIG. 1 shows a schematic perspective elevation view of an Active Shooter Protection System containing a fold-down panel of ballistic cloth, according to some embodiments of the present invention.

The specific details of the single embodiment or variety of embodiments described herein are set for in this application. Any specific details of the embodiments are used for demonstration purposes only, and no unnecessary limitation or inferences are to be understood therefrom.

Before describing in detail exemplary embodiments, it is noted that the embodiments reside primarily in combinations of components related to the system. Accordingly, the device components have been represented where appropriate by convention symbols in the drawings, showing only those specific details that are pertinent to understanding the embodiments of the present disclosure so as not to obscure the disclosure with details that will be readily apparent to those of ordinary skill in the art having the benefit of the description herein.

The words "sheet", "cloth", "blanket", "panel" and "shield" are used interchangeably herein, in reference to a "ballistic sheet/cloth/blanket/panel/shield". Small differences between these terms depends primarily on the thickness of the ballistic material (a thin material is more like a "sheet", while a thick material is more like a "blanket"). A "shield" could also comprise a stiffening agent, such as epoxy, to make a stiff composite panel of ballistic material+epoxy.

The ballistic material used in these embodiments can be made of relatively thick (e.g., ¼"-⅜") woven fibers comprising ultra-high-strength polymer fibers, including: Kevlar™, Spectra Shield™, Dyneema™, Twaron™ UHMWPE (Ultra-high molecular weigh t-polyetheylene) fibers, and graphite fibers, and/or combinations thereof. Additionally, ceramic plates or ceramic/metal composites can be mounted inside of the ballistic material for additional protection. Alternatively, ballistic panels may comprise graphite fibers woven into a 2-D or 3D form that is impregnated with a curable polymeric resin/activator system (such as epoxy) to stiffen the panels and make them rigid. Alternatively, the ballistic panels can be, or can contain, large or small high-strength steel plates (for example, ⅛"-¼" thick). However, the weight of such steel inserts or steel panels may be a concern, because a large steel plate that falls (rotates) down rapidly can be a hazard to children and adults.

FIG. 1 shows a schematic perspective elevation view of an Active Shooter Protection System (ASPS) 8 with a fold-down panel of ballistic cloth (can't be seen in this view), according to some embodiments of the present invention, in a pre-deployed configuration. ASPS 8 comprises a hinged upper plate 14 that is held in a permanent horizontal position by a pair of vertical support posts 16, 16' that are attached to the ceiling 15. Door locking plate 24 has deployed and locked the door from opening (in addition to a dead-bolt lock (not shown), if present at all). System activation (Pull) box 20 is mounted about ½ way up the doorjamb 12 of door 10, and a connecting rod/bar 22 goes from pull-down box 20 connecting to the top corner of horizontal plate 14. A lower position for pull-down box 20 can also be used to provide easy wheelchair access. Alternatively, a handle 9 can be attached to lower plate 34 to assist in deploying the ASPS system 8, since most children would not be able to reach the handle easily, without using a chair to stand on.

Figure 2:
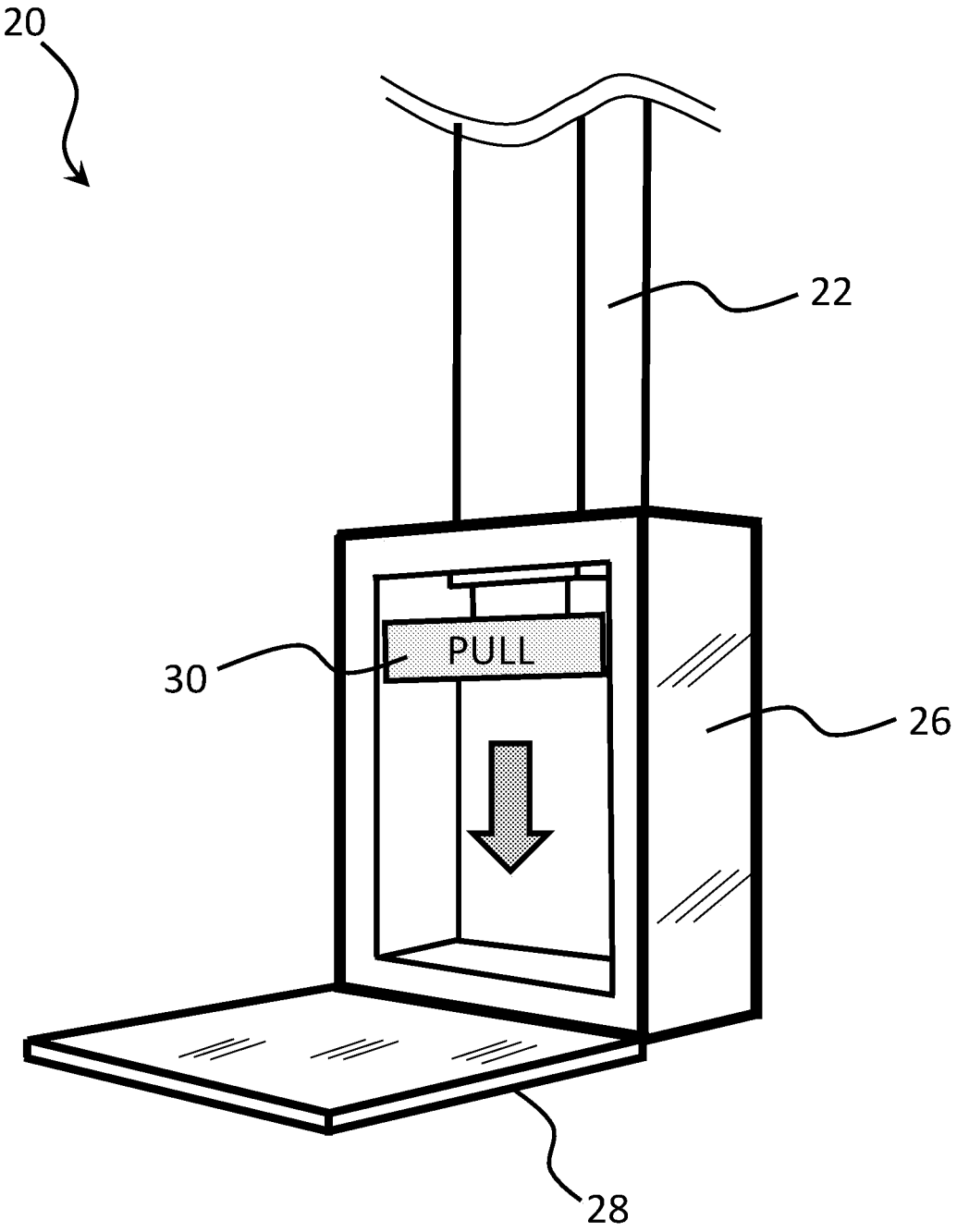
FIG. 2 shows a schematic perspective elevation view of a pull-down box that is used for activating an Active Shooter Protection System, according to some embodiments of the present invention.

FIG. 2 shows a schematic perspective elevation view of a pull-down switch box 20 that is used for activating an Active Shooter Protection System 8, according to some embodiments of the present invention. Pulling down on the horizontal bar marked "PULL" 30 inside of open-faced box 26 activates the ASPS 8 by pulling down vertical rod/bar 22, which releases a pin, or activates some other release mechanism (not shown), to release the ballistic panels, which simply fall down by gravity. Switch/activation box 20 can have a transparent plastic or glass cover plate that is hinged on its bottom edge, to deter tampering with the system 8 (much like a fire alarm box).

Figure 3:
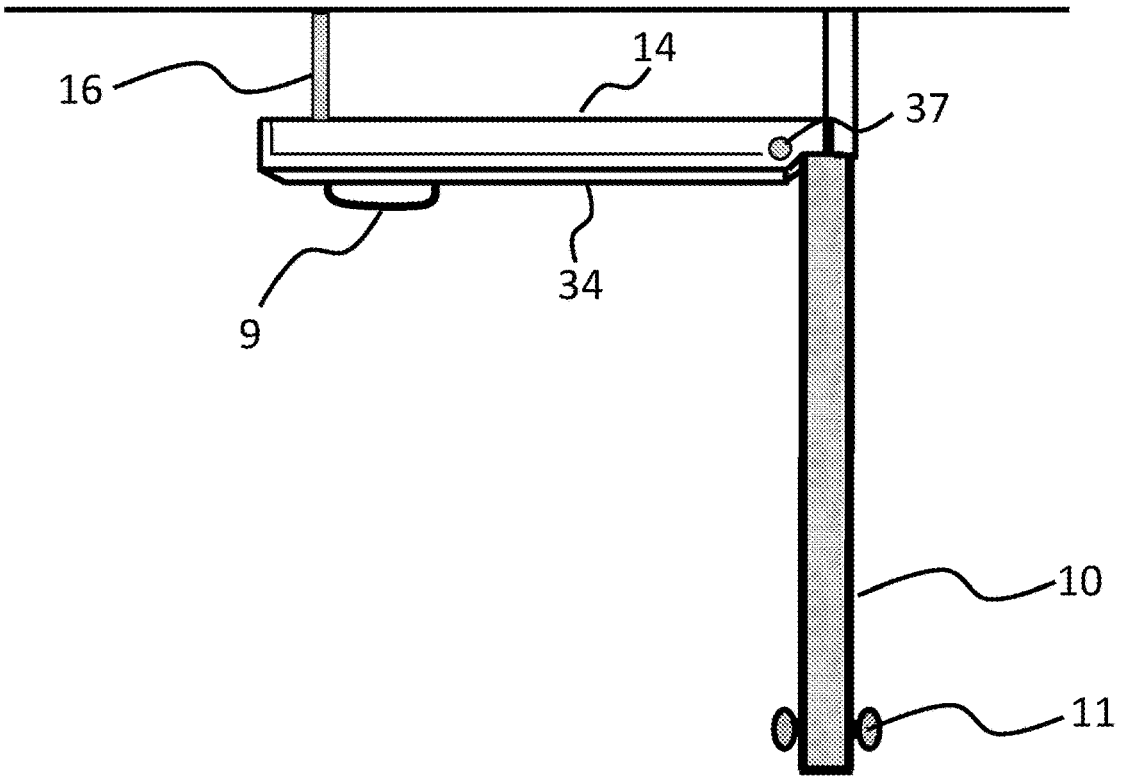
FIG. 3 shows a schematic side elevation view of an Active Shooter Protection System with a fold-down panel of ballistic cloth, according to some embodiments of the present invention.

FIG. 3 shows a schematic side elevation view of an Active Shooter Protection System 8 with a fold-down panel of ballistic material 36, according to some embodiments of the present invention. Upper plate 14 is fixed in a horizontal orientation by vertical support post 16. Alternatively, a handle 9 can be attached to lower plate 34 to assist in deploying the ASPS system 8. Alternatively, a Velcro™ strap (not shown) can be used to hold lower plate 34 in place prior to deployment, which must be un-hooked in order to deploy the ASPS 8. Alternatively, or additionally, one or more magnets can be used to hold lower plate 34 in place before deployment, providing about 5-10 lbs of holding force, that can be easily overcome by pulling on handle 9. Alternatively, the ballistic blanket 36 can further comprise epoxy impregnation of the ballistic material that makes it stiff.

Figure 4:
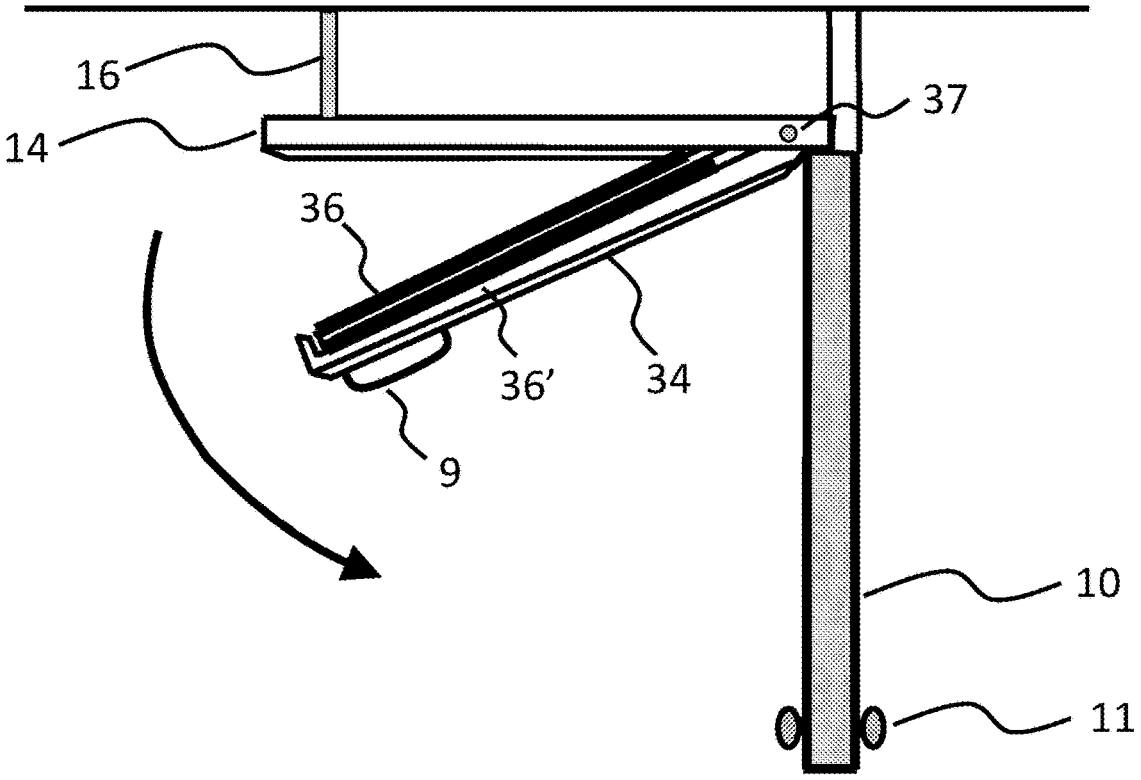
FIG. 4 shows a schematic side elevation view of an Active Shooter Protection System with a fold-down panel of ballistic cloth, according to some embodiments of the present invention.

FIG. 4 shows a schematic side elevation view of an Active Shooter Protection System 8 with a fold-down panel of ballistic cloth, in a partially-deployed position, according to some embodiments of the present invention. Upper plate 14 is fixed in a horizontal orientation by vertical support post 16. When pull-box 20 is activated, hinged support plate/tray 34 is released and panel 36 and lower plate 34 rotate downwards via gravity. Alternatively, a hydraulic piston/strut (not shown) can be used to slow down the deployment of ASPS 8. Plates 14 and 34 are generally made of a metal or metal alloy, preferably aluminum, but can also be steel. Lower plate 34 rotates about hinge pin 37. The degree of increased friction afforded by hinge bolt 37 can be adjusted by tightening/loosening a nut (not shown) attached to bolt 37. Alternatively, a handle 9 can be attached to plate 34 to assist in deploying the ASPS system 8. Alternatively, or additionally, one or more magnets can be used to hold lower plate 34 up against upper plate 14 before deployment, providing, for example, about 5-10 lbs of holding force to upper plate 14, that can be easily overcome by pulling down on handle 9. Alternatively, lower plate 34 can be held in place to upper plate 14 with a loop of rope or Velcro™ that is simple unhooked from plate 14 during deployment. Alternatively, lower plate 34 can be made of ⅛"-⅜" steel plate, which affords additional ballistic protection for at least the upper-half of door 10.

Figure 5:
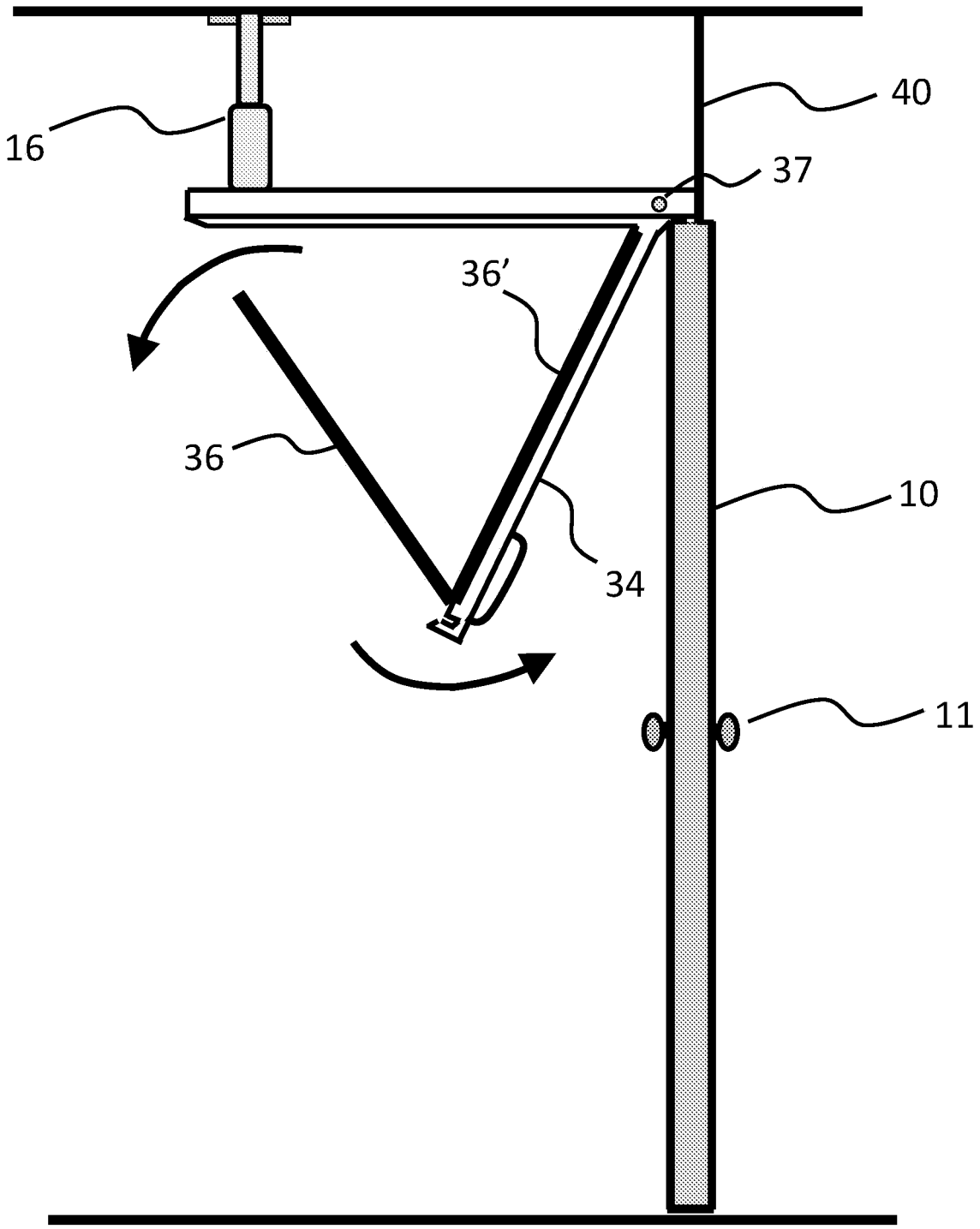
FIG. 5 shows a schematic side elevation view of an Active Shooter Protection System with a fold-down panel of ballistic cloth, according to some embodiments of the present invention.

FIG. 5 shows a schematic side elevation view of an Active Shooter Protection System 8 with a fold-down panel of ballistic cloth 36, in a partially-deployed position, according to some embodiments of the present invention. Upper plate 14 is fixed in a horizontal orientation by vertical support post 16. When pull-box 20 is activated, hinged lower plate 34 is released and rotates down via gravity, thereby partially exposing ballistic panel 36. Lower plate 34 rotates about hinge pin 37.

Figure 6:
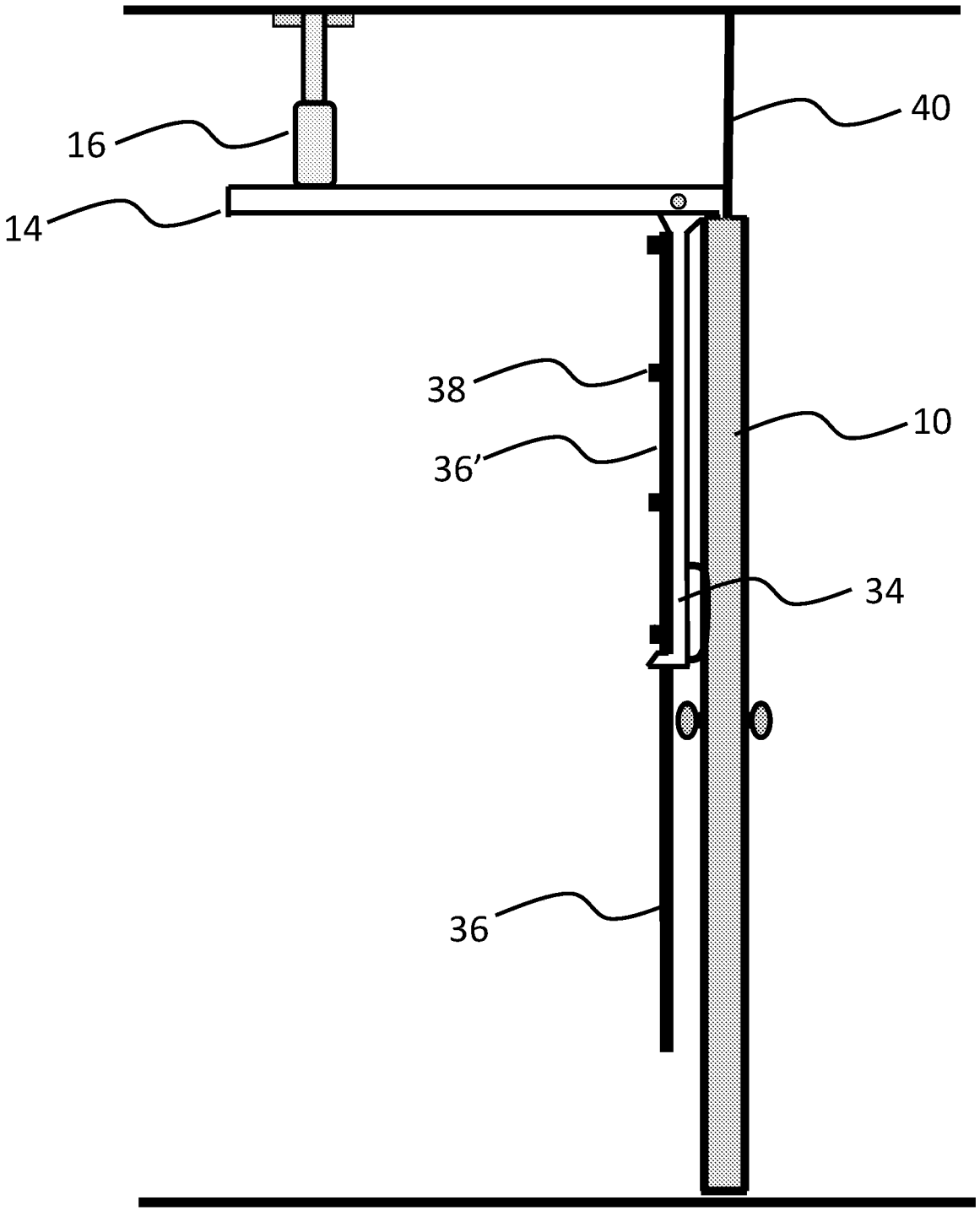
FIG. 6 shows a schematic side elevation view of an Active Shooter Protection System with a fold-down panel of ballistic cloth, in a fully-deployed configuration, according to some embodiments of the present invention.

FIG. 6 shows a schematic side elevation view of an Active Shooter Protection System 8 with a fold-down panel of ballistic cloth, in a fully-deployed configuration, according to some embodiments of the present invention. Ballistic panel 36 hangs straight down by gravity. The upper portion of panel 36 is attached to lower plate 34 by a plurality of rivets or grommets 38.

Figure 7:
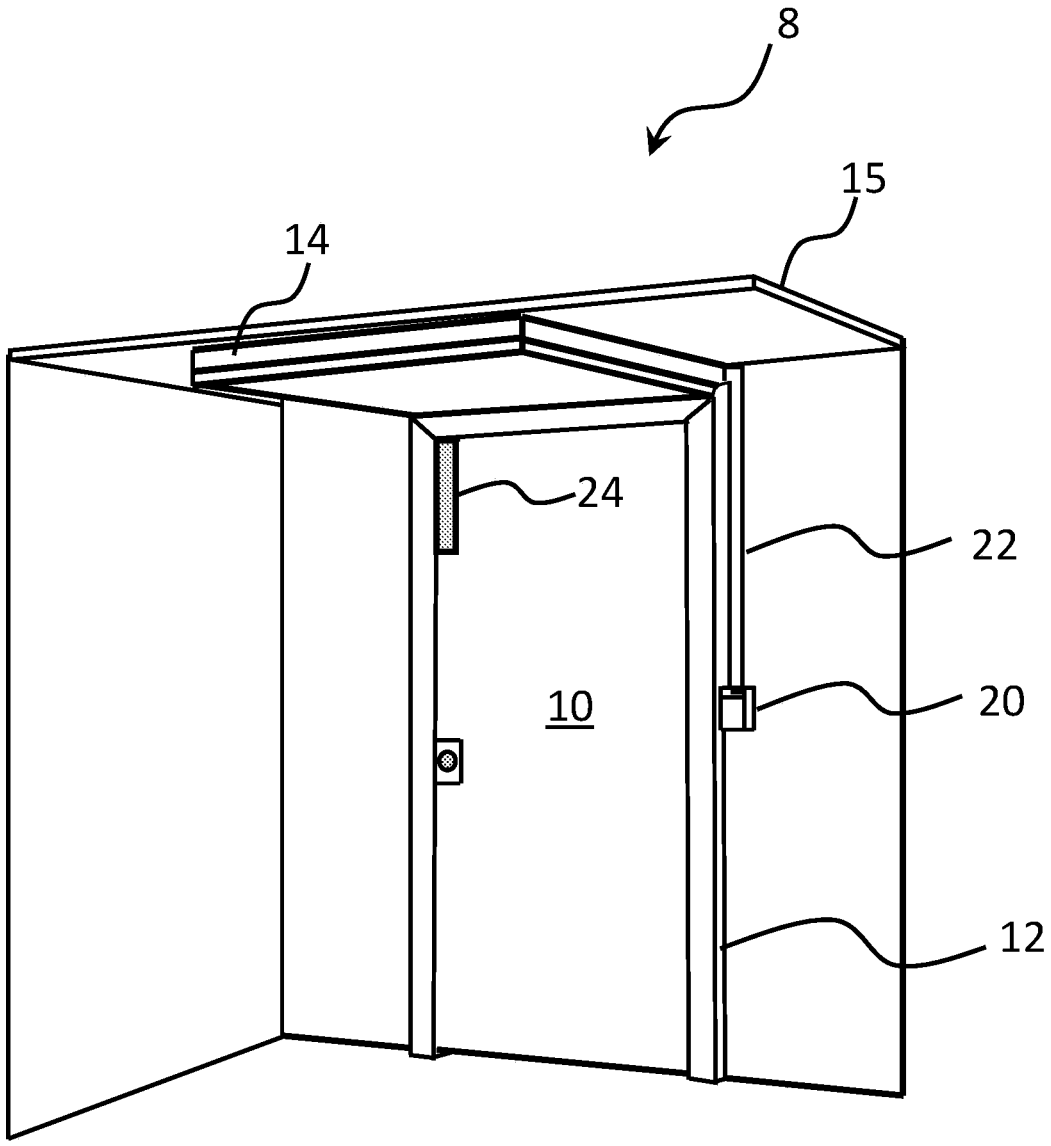
FIG. 7 shows a schematic perspective elevation view of an Active Shooter Protection System with a fold-down panel of ballistic cloth and with a locking plate in a locked position, according to some embodiments of the present invention.

FIG. 7 shows a schematic perspective elevation view of an Active Shooter Protection System 8 with fold-down panel of ballistic cloth (not shown) and with a door locking plate 24 in a door-locked position, according to some embodiments of the present invention. Upper support plate 14 is mounted securely to ceiling 15. Pull-box 20 and connecting rod/bar 22 can be seen.

Figure 8:
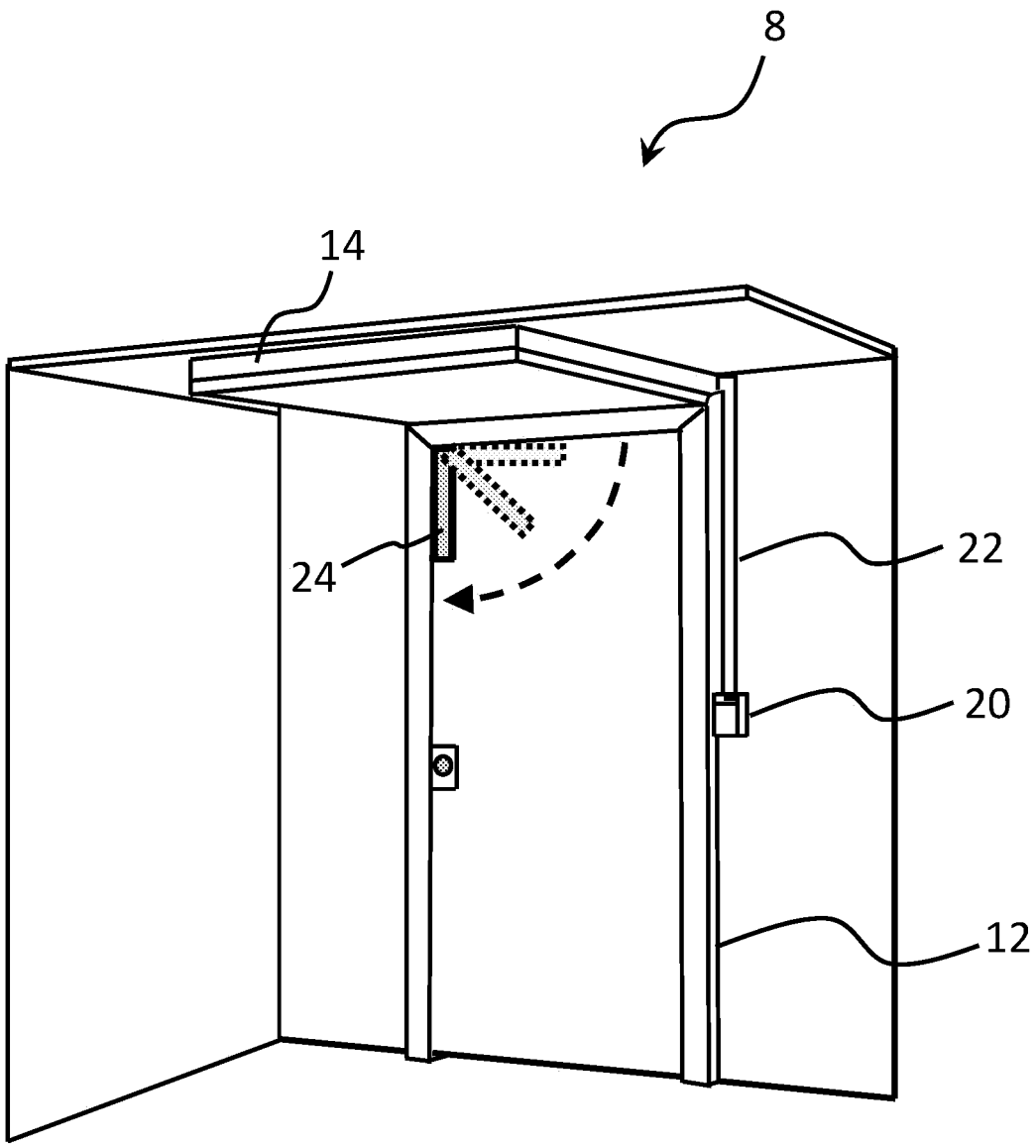
FIG. 8 shows a schematic perspective elevation view of an Active Shooter Protection System with a pair of fold-down panels of ballistic cloth, illustrating deployment of a locking plate, according to some embodiments of the present invention.

FIG. 8 shows a schematic perspective elevation view of an Active Shooter Protection System 8 with a fold-down panel of ballistic cloth (not shown), illustrating deployment of a door locking plate 24 after being released by pull-box 20, according to some embodiments of the present invention.

Figure 9:
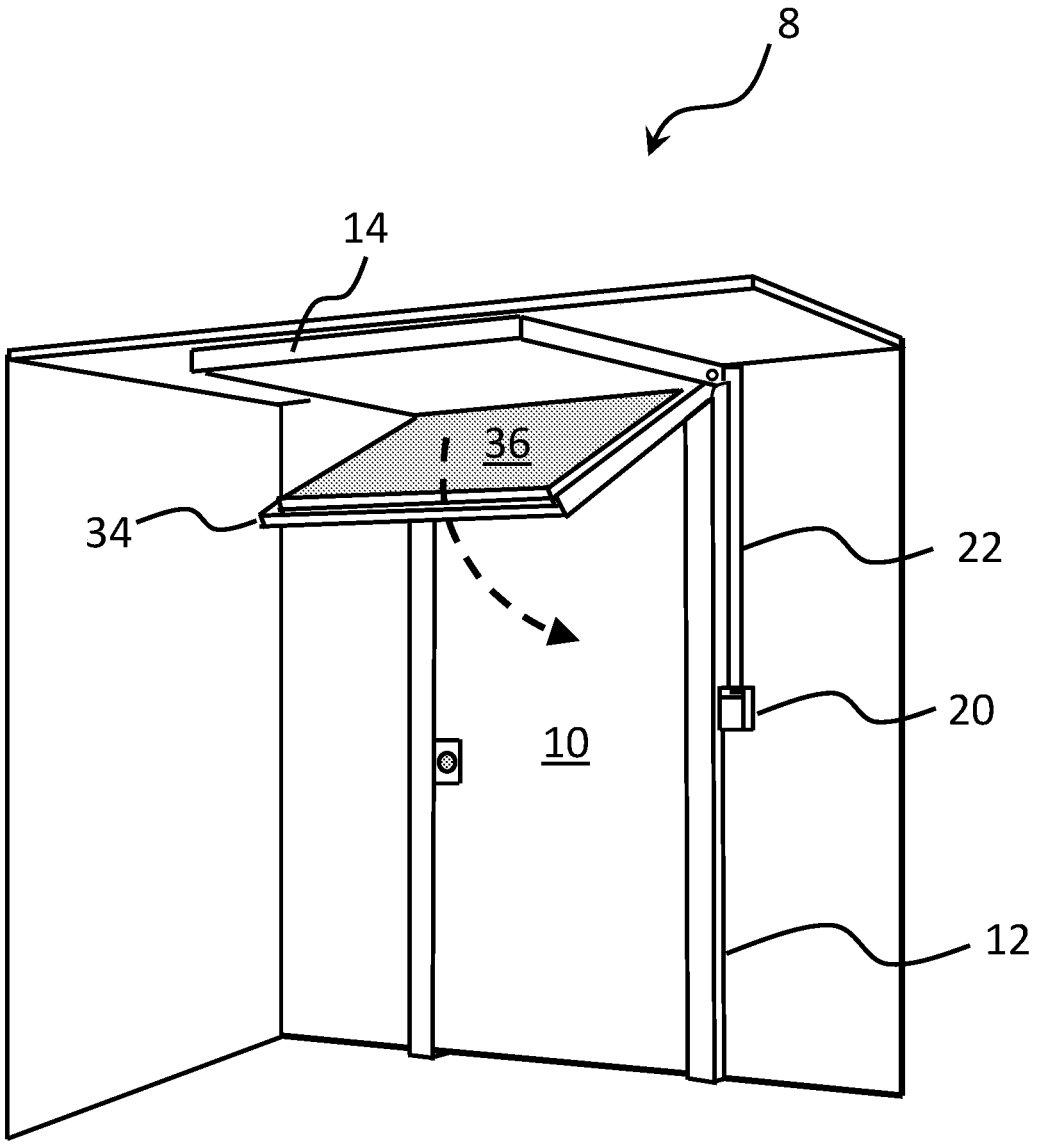
FIG. 9 shows a schematic perspective elevation view of an Active Shooter Protection System with a fold-down panel of ballistic cloth, according to some embodiments of the present invention.

FIG. 9 shows a schematic perspective elevation view of an Active Shooter Protection System 8 with a fold-down panel of ballistic cloth 36 (not seen) in a partially-deployed position, according to some embodiments of the present invention.

Figure 10:
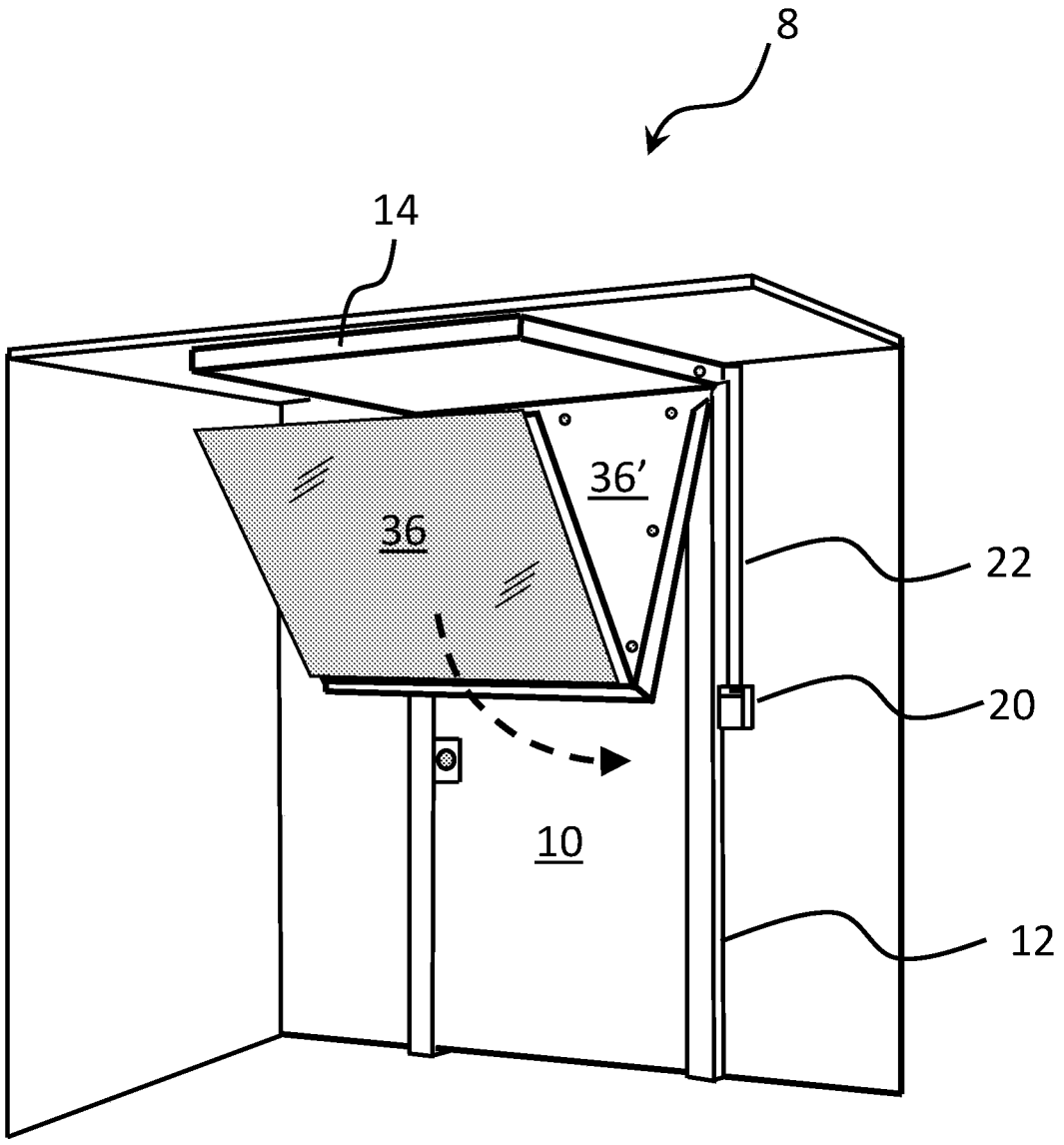
FIG. 10 shows a schematic perspective elevation view of an Active Shooter Protection System with a fold-down panel of ballistic cloth, according to some embodiments of the present invention.

FIG. 10 shows a schematic perspective elevation view of an Active Shooter Protection System 8 with a fold-down panel of ballistic cloth 36 in a partially-deployed configuration, according to some embodiments of the present invention.

Figure 11:
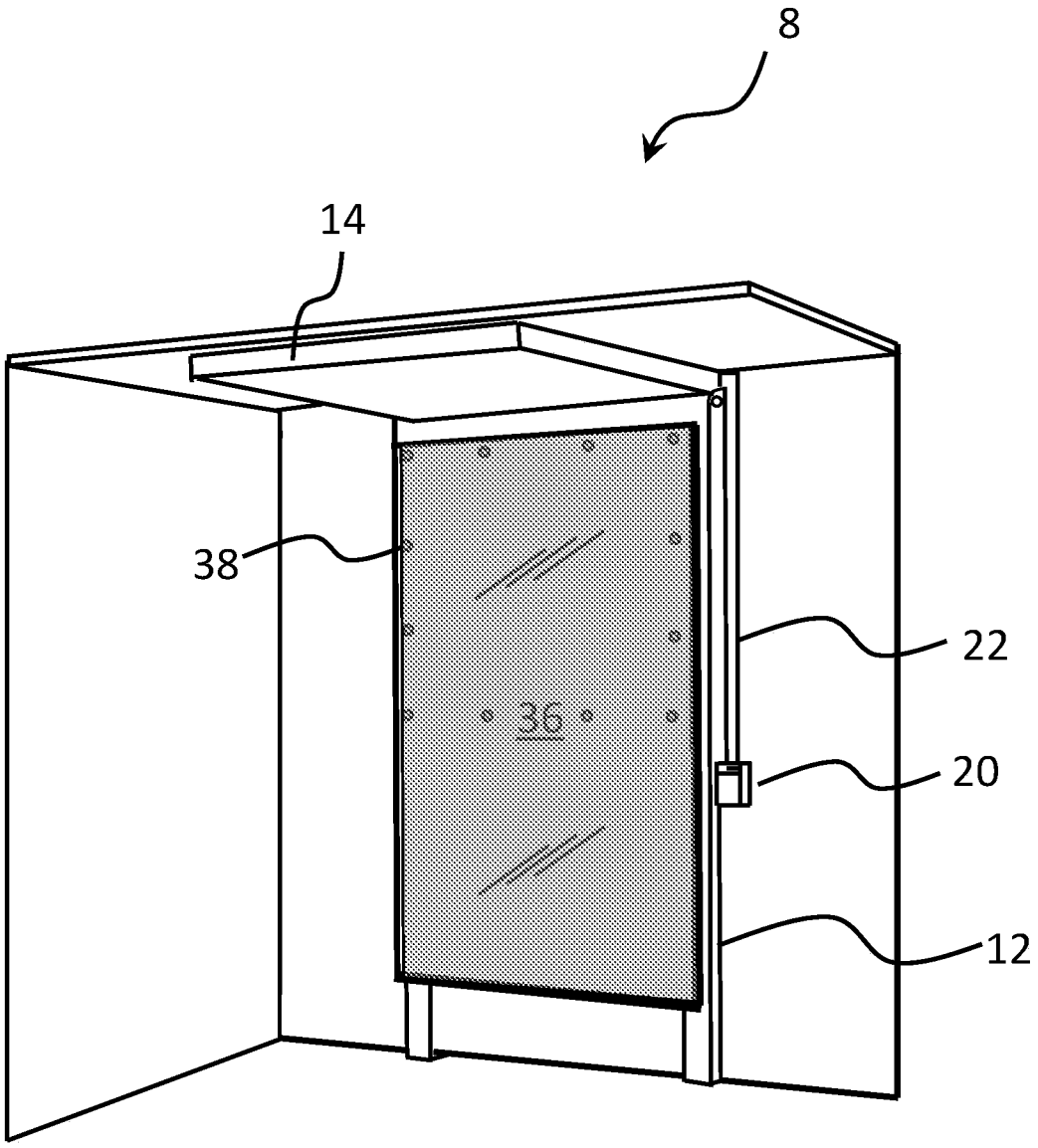
FIG. 11 shows a schematic perspective elevation view of an Active Shooter Protection System with a fold-down panel of ballistic cloth, in a fully-deployed configuration, according to some embodiments of the present invention.

FIG. 11 shows a schematic perspective elevation view of an Active Shooter Protection System 8 with a fold-down panel of ballistic cloth 36, in a fully-deployed configuration, according to some embodiments of the present invention.

Figure 12A:
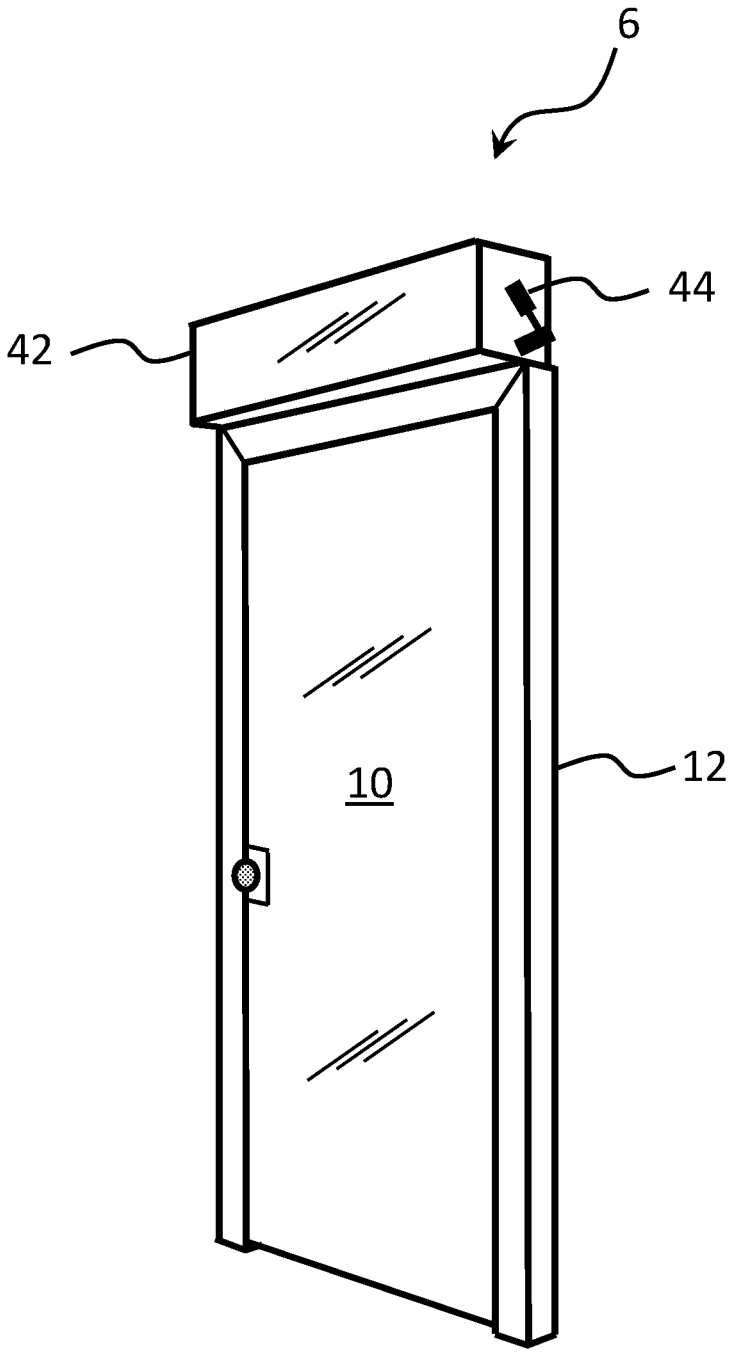
FIG. 12A shows a schematic perspective elevation view of an Active Shooter Protection System with a bundle of folded-up, pleated panels of ballistic cloth in a packaged configuration, according to some embodiments of the present invention.

FIG. 12A shows a schematic perspective elevation view of an Active Shooter Protection System 6 with a bundle of folded-up, pleated, sub-panels of ballistic cloth (not shown) contained in a box 42 in a fully-packaged configuration, according to some embodiments of the present invention. A hollow box 42 is mounted to the wall (not shown) above the top of door plate 12. Box 42 contains the folded-up pleated sub-panels of ballistic cloth (not shown). Activation handle 44 is attached to a side of box 42.

Figure 12B:
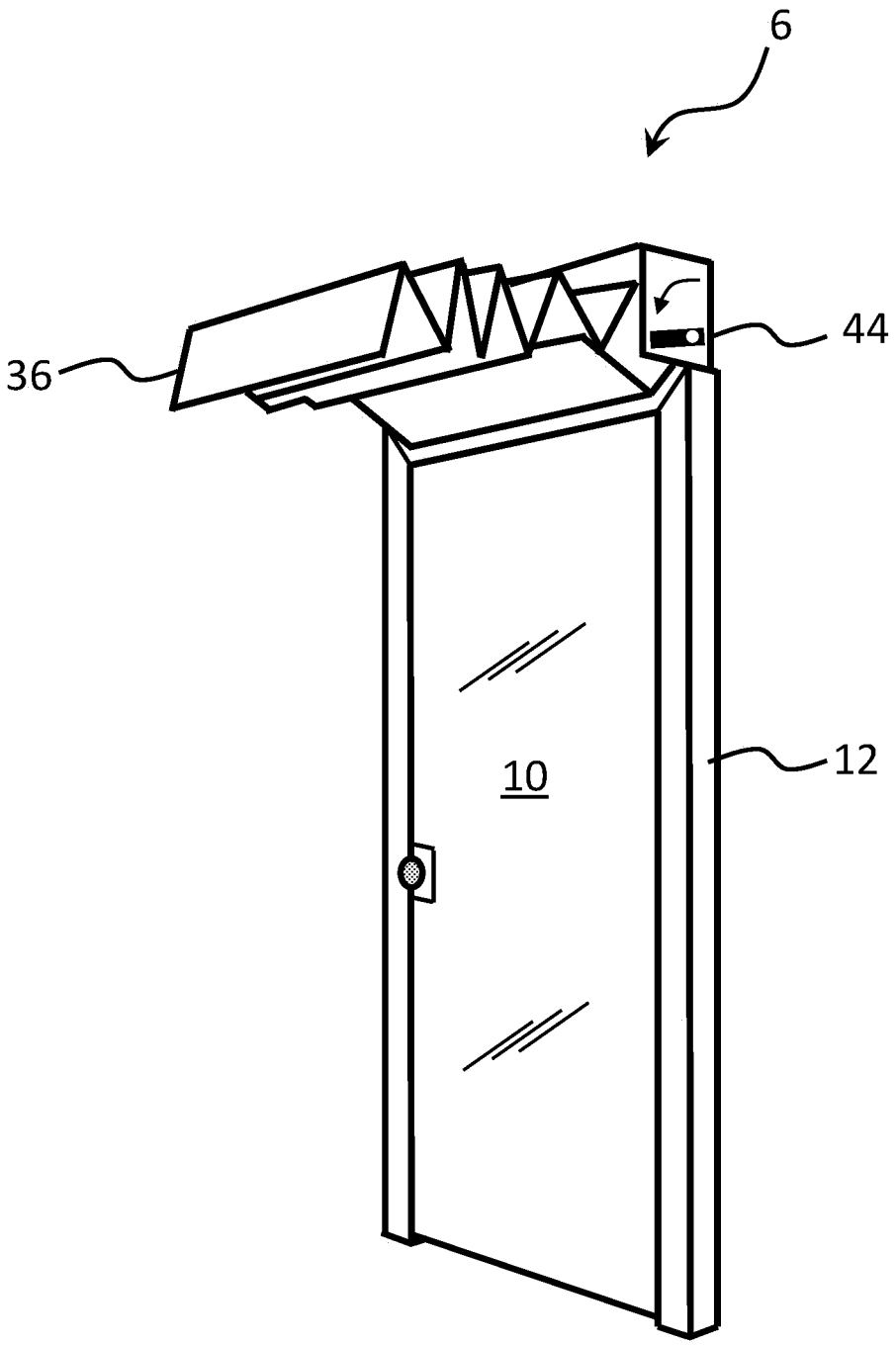
FIG. 12B shows a schematic perspective elevation view of an Active Shooter Protection System with pleated panels of ballistic cloth in a partially-deployed configuration, according to some embodiments of the present invention.

FIG. 12B shows a schematic perspective elevation view of an Active Shooter Protection System 6 with pleated sub-panels of ballistic cloth in a partially-deployed configuration, after turning the activation handle 44 to the "DOWN" position, according to some embodiments of the present invention.

Figure 12C:
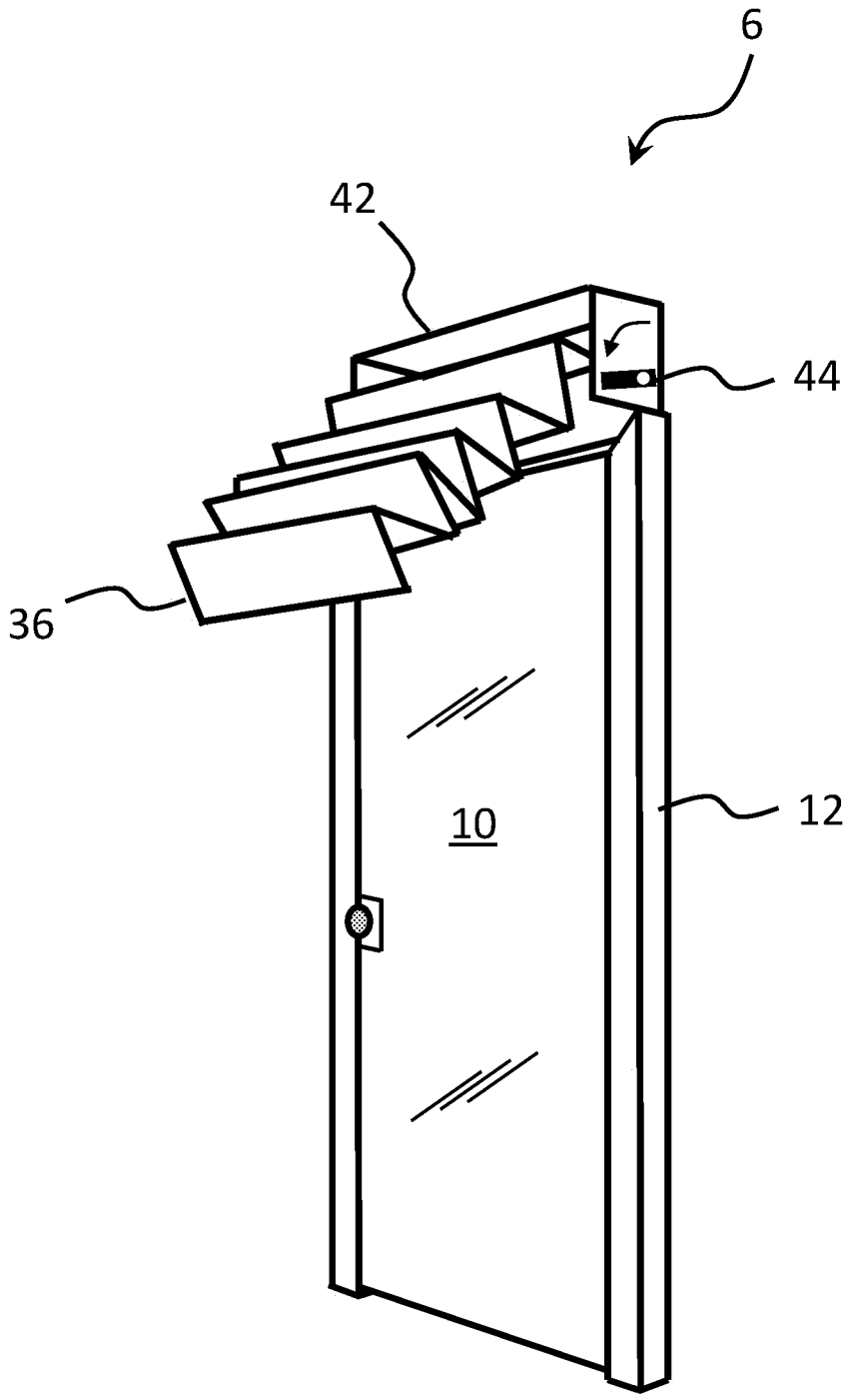
FIG. 12C shows a schematic perspective elevation view of an Active Shooter Protection System with pleated panels of ballistic cloth in a partially-deployed configuration, according to some embodiments of the present invention.

FIG. 12C shows a schematic perspective elevation view of an Active Shooter Protection System 6 with pleated sub-panels of ballistic cloth 36 in a partially-deployed configuration, according to some embodiments of the present invention.

Figure 12D:
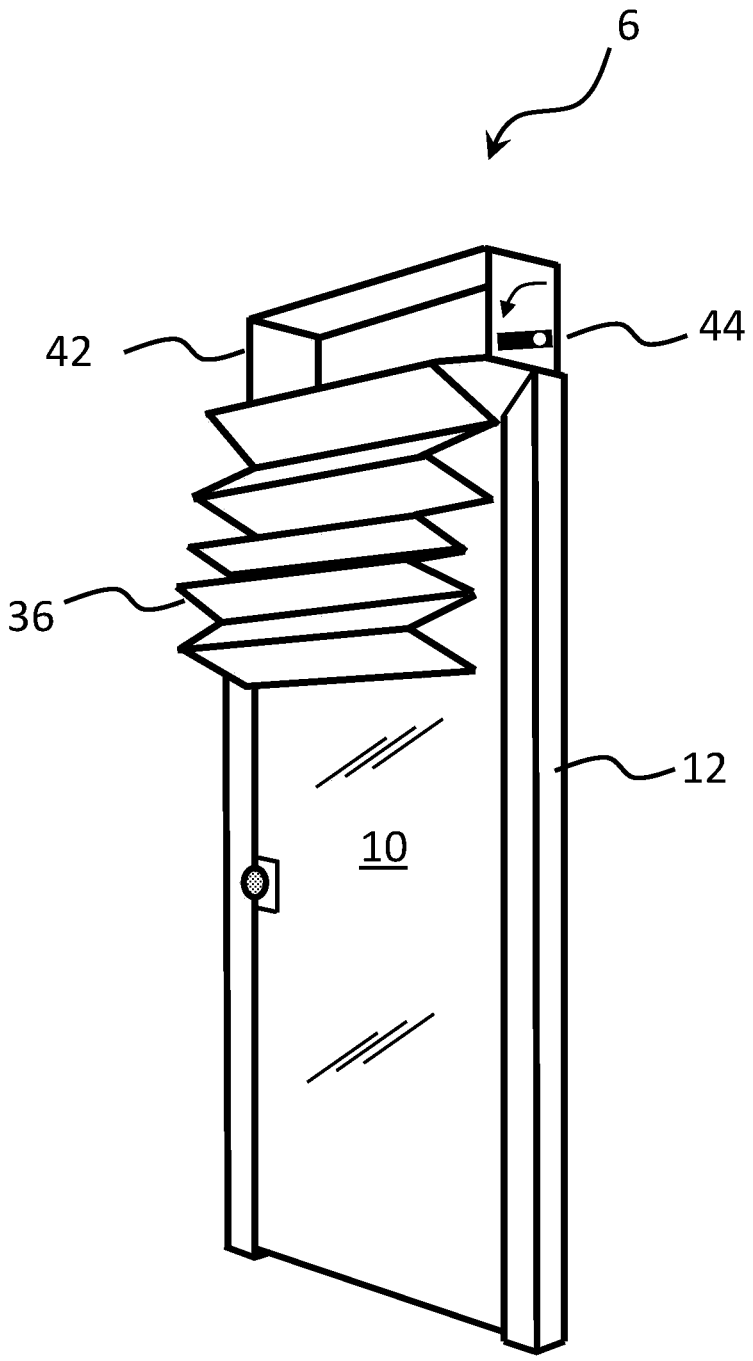
FIG. 12D shows a schematic perspective elevation view of an Active Shooter Protection System with pleated panels of ballistic cloth in a partially-deployed configuration, according to some embodiments of the present invention.

FIG. 12D shows a schematic perspective elevation view of an Active Shooter Protection System 6 with pleated sub-panels of ballistic cloth in a partially-deployed configuration, after turning the activation handle 44 to the "DOWN" position, according to some embodiments of the present invention.

Figure 12E:
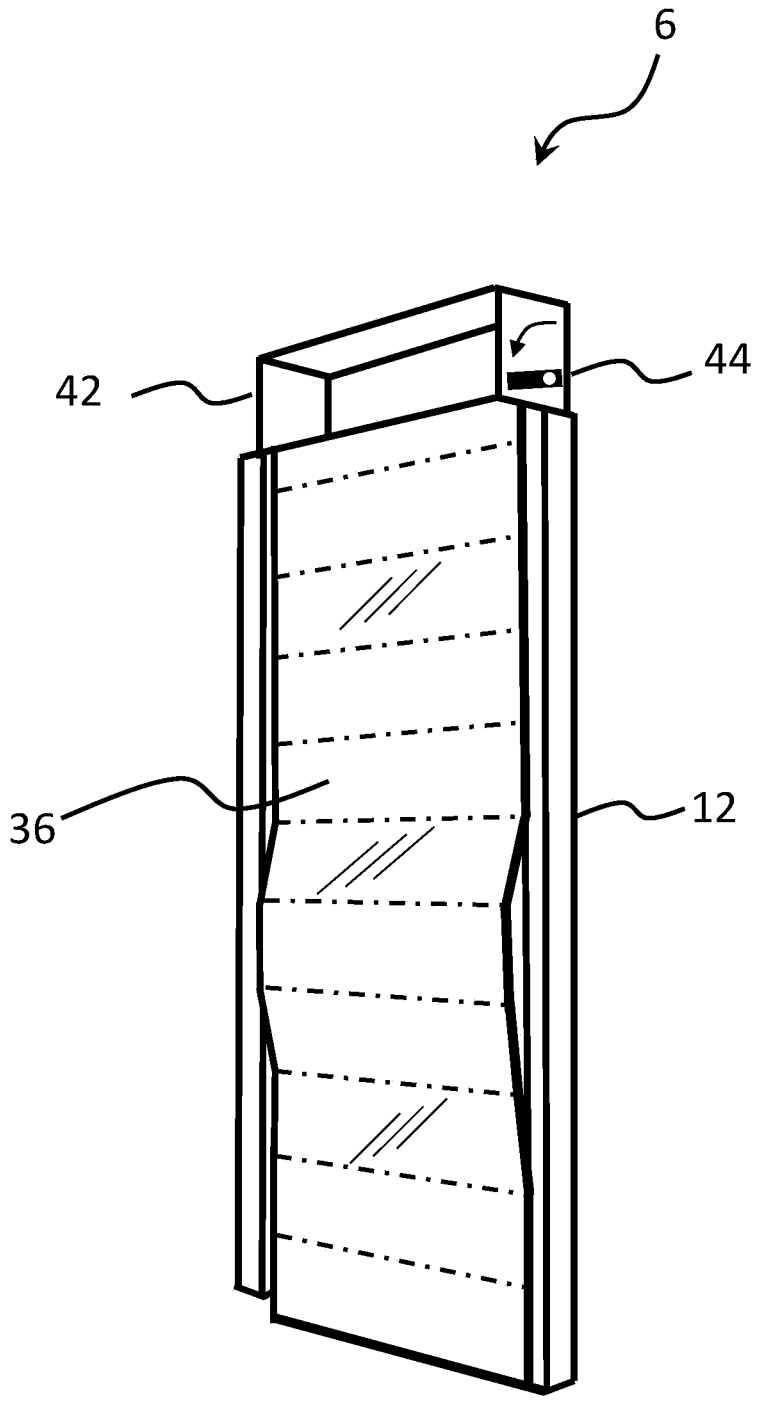
FIG. 12E shows a schematic perspective elevation view of an Active Shooter Protection System with pleated panels of ballistic cloth in a fully-deployed configuration, according to some embodiments of the present invention.

FIG. 12E shows a schematic perspective elevation view of an Active Shooter Protection System 6 with pleated sub-panels of ballistic cloth in a fully-deployed configuration, according to some embodiments of the present invention. A single sheet 36 of ballistic material completely covers door 10 (which is hidden).

Figure 13A:
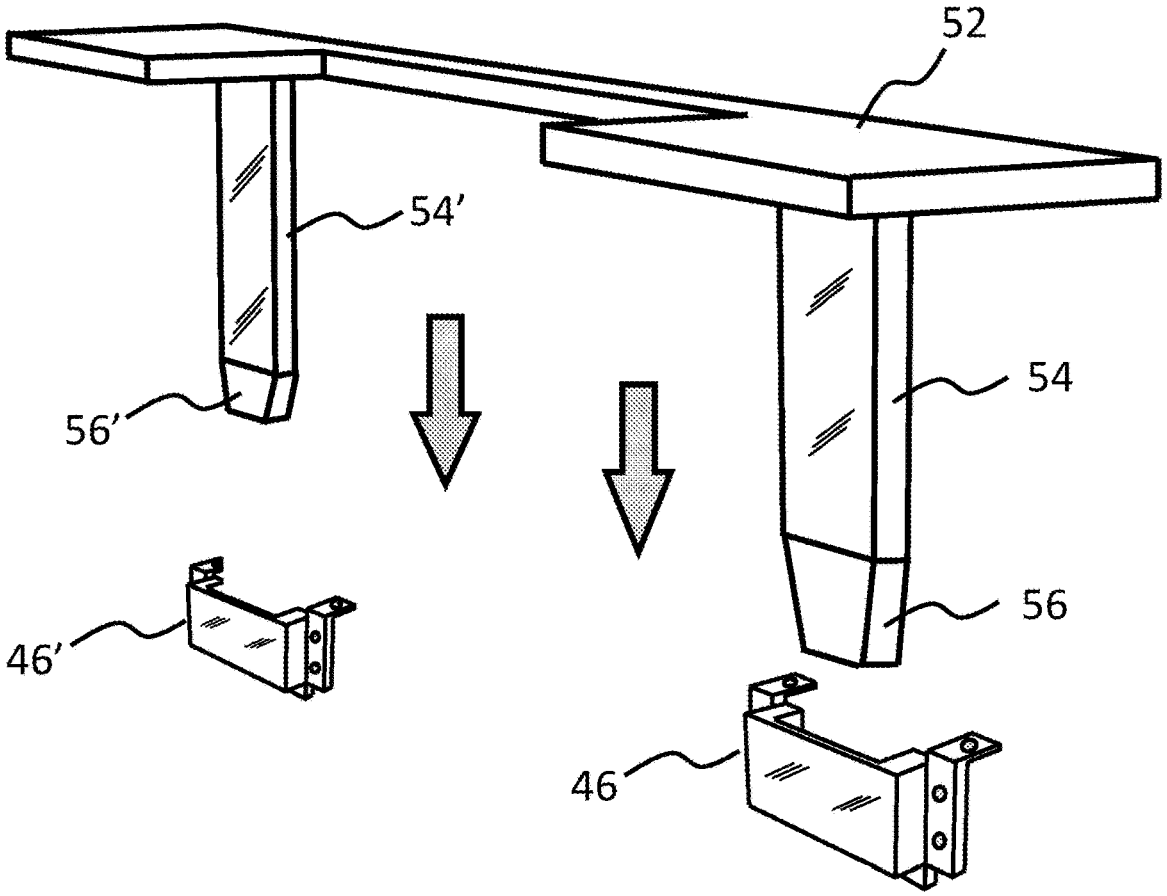
FIG. 13A shows a schematic perspective elevation view of a horizontal plate with a pair of vertical locking bars with a tapered tip, according to some embodiments of the present invention, prior to insertion of the tapered tip into a latching bracket.

FIG. 13A shows a schematic perspective elevation view of a heavy duty, horizontal locking plate 52 with a pair of vertical locking bars 54, 54' with tapered tips 56, 56', respectively, according to some embodiments of the present invention, prior to insertion into a pair of latching brackets 46, 46', respectively. Locking plate 52 needs to be made of a heavy, dense material, such as steel.

Figure 13B:
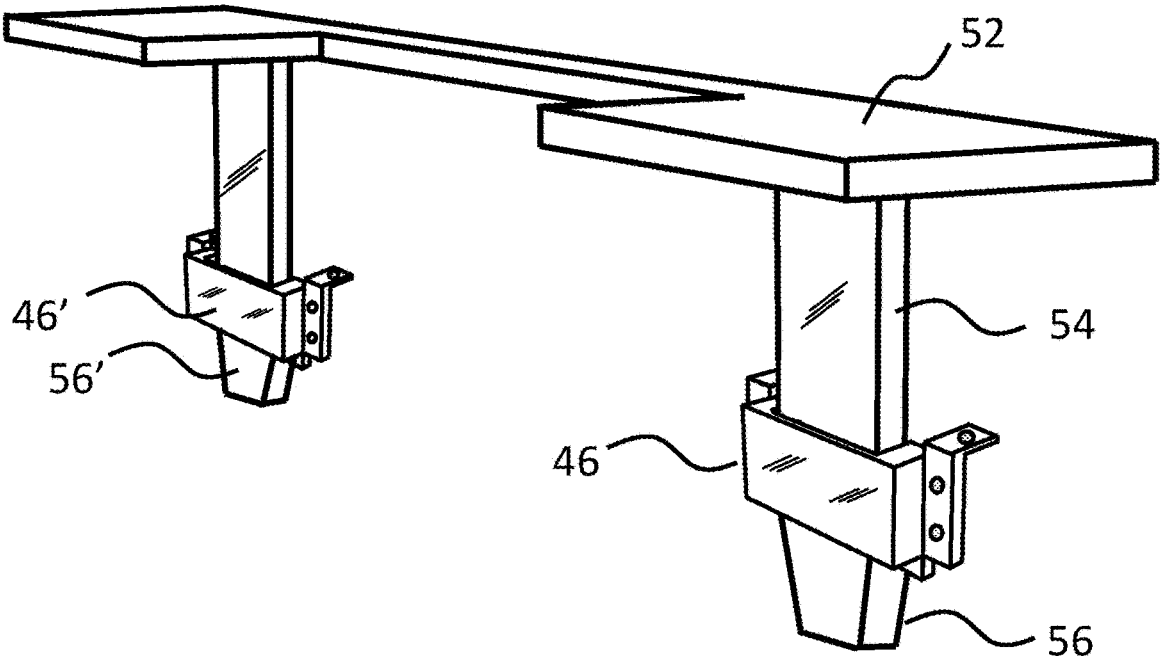
FIG. 13B shows a schematic perspective elevation view of a horizontal plate with a pair of vertical locking bars, according to some embodiments of the present invention, after insertion of the locking bars into a pair of latching brackets.

FIG. 13B shows a schematic perspective elevation view of a heavy duty, horizontal locking plate 52 with a pair of vertical locking bars, 54, 54' with tapered tips 56, 56', respectively according to some embodiments of the present invention, after insertion into a pair of latching brackets 46, 46'. Note that in other embodiments, locking bar 52 may comprise a single vertical locking bar 54, placed in the middle of plate 52, instead of a pair of locking bars 54, 54'.

Figure 14:
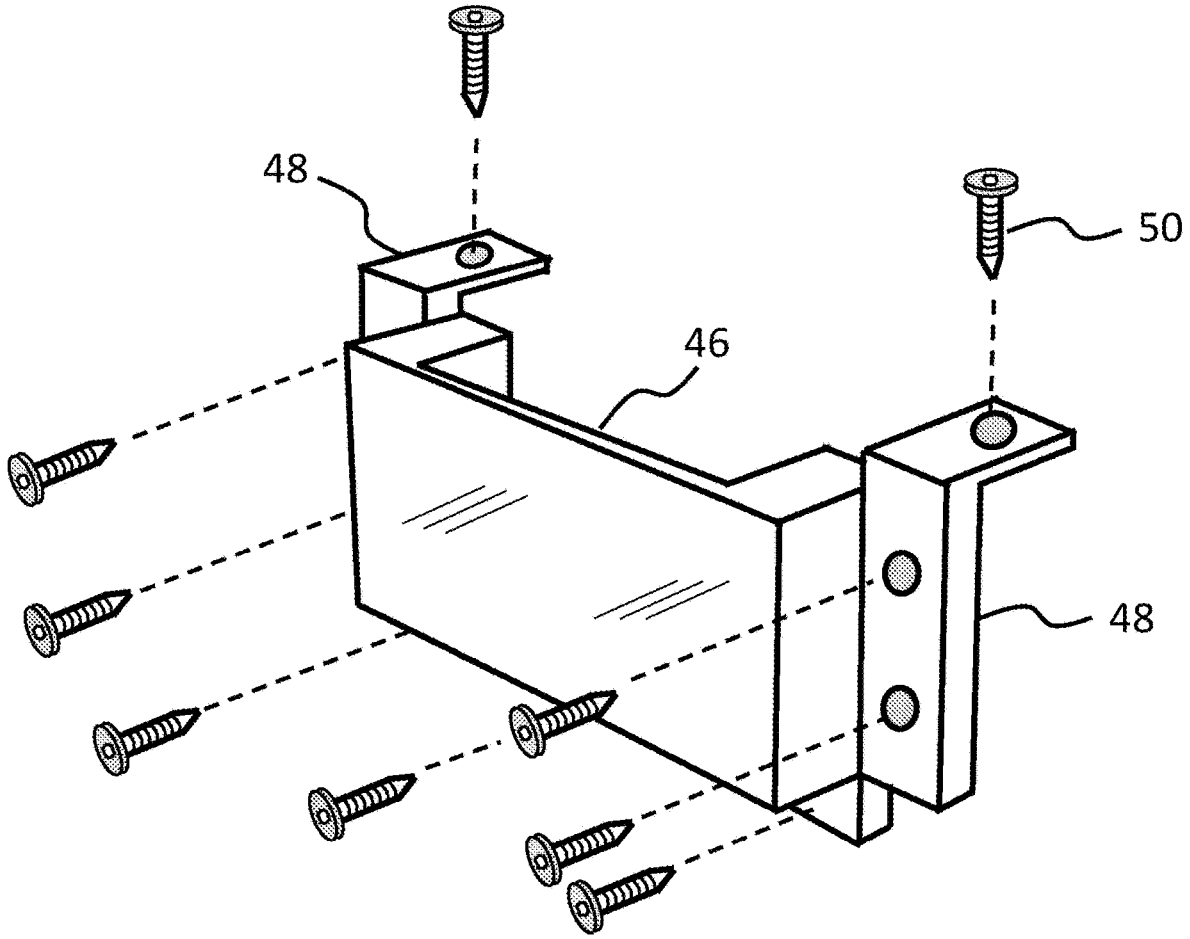
FIG. 14 shows a schematic perspective elevation view of a latching plate and attachment screws, according to some embodiments of the present invention.

FIG. 14 shows a schematic perspective elevation view of a U-shaped latching bracket 46 and attachment screws 50, according to some embodiments of the present invention. Latching plate 46 further comprises a pair of integral L-shaped end brackets 48, 48', that are used for hooking over the top of door 10 (not shown).

Figure 15A:
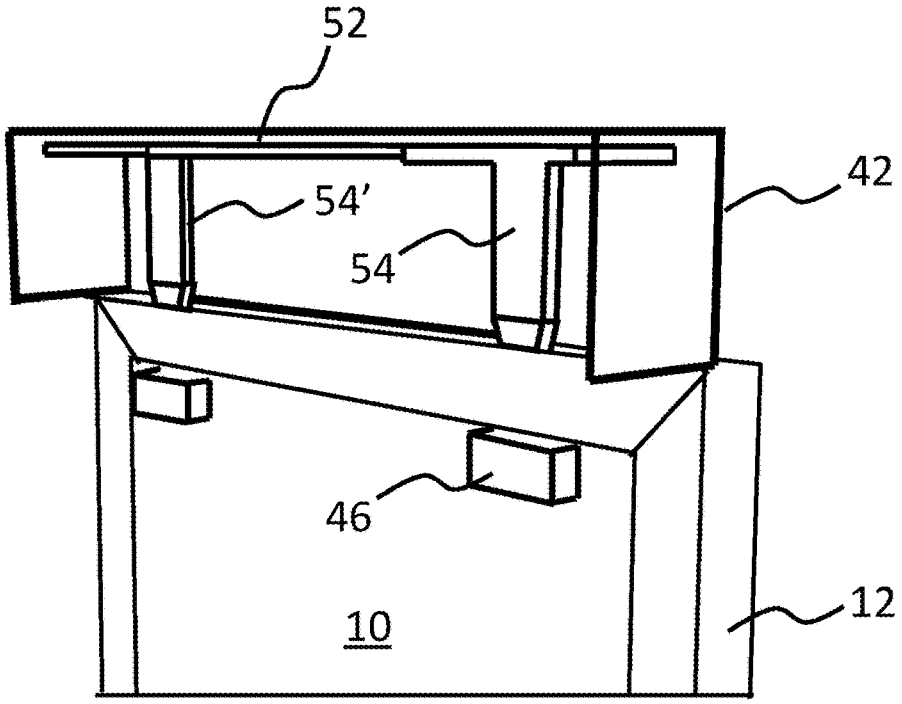
FIG. 15A shows a schematic perspective elevation view of an Active Shooter Protection System, according to some embodiments of the present invention, before deployment of the locking bars.

FIG. 15A shows a schematic perspective elevation view of an Active Shooter Protection System 6, according to some embodiments of the present invention, before deployment of the locking bars 54, 54'.

Figure 15B:
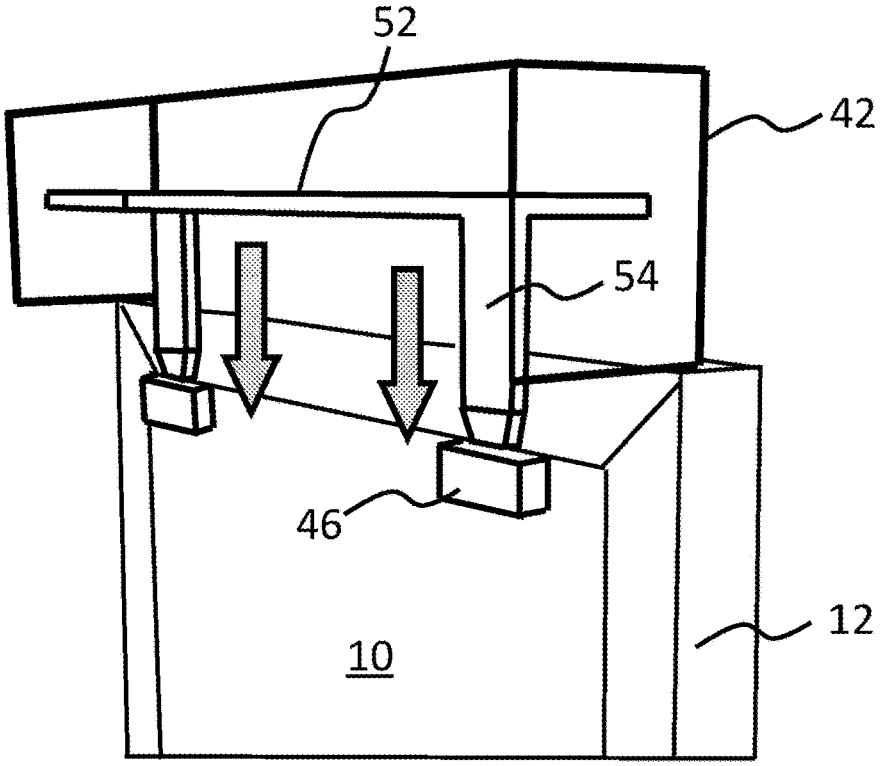
FIG. 15B shows a schematic perspective elevation view of an Active Shooter Protection System, according to some embodiments of the present invention, during partial-deployment of the locking bars.

FIG. 15B shows a schematic perspective elevation view of an Active Shooter Protection System 6, according to some embodiments of the present invention, during partial-deployment of the locking bars 54, 54'.

Figure 15C:
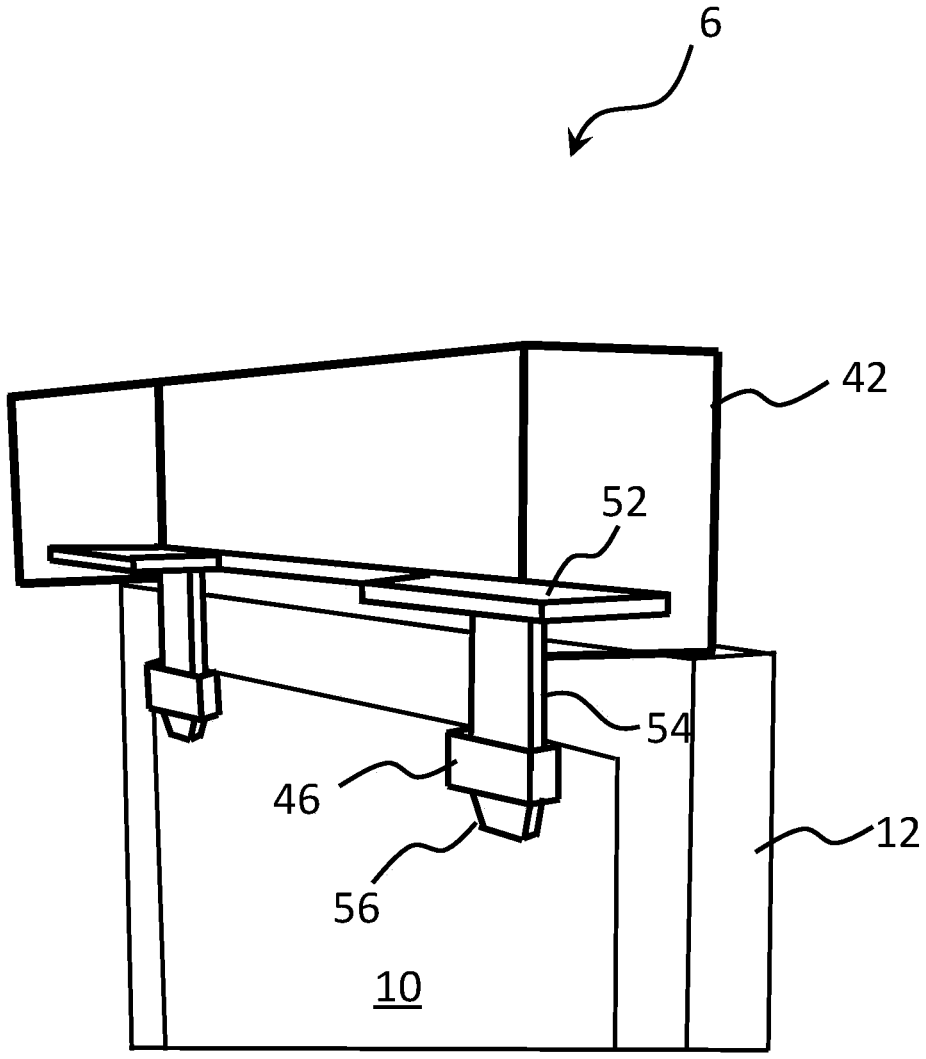
FIG. 15C shows a schematic perspective elevation view of an Active Shooter Protection System, according to some embodiments of the present invention, that is fully-deployed, with the door being locked.

FIG. 15C shows a schematic perspective elevation view of an Active Shooter Protection System 6, according to some embodiments of the present invention, with full-deployment of the locking bars 54, 54' (which locks the door 10 using locking brackets 46, 46' attached to the top of door 10.

Figure 16A:
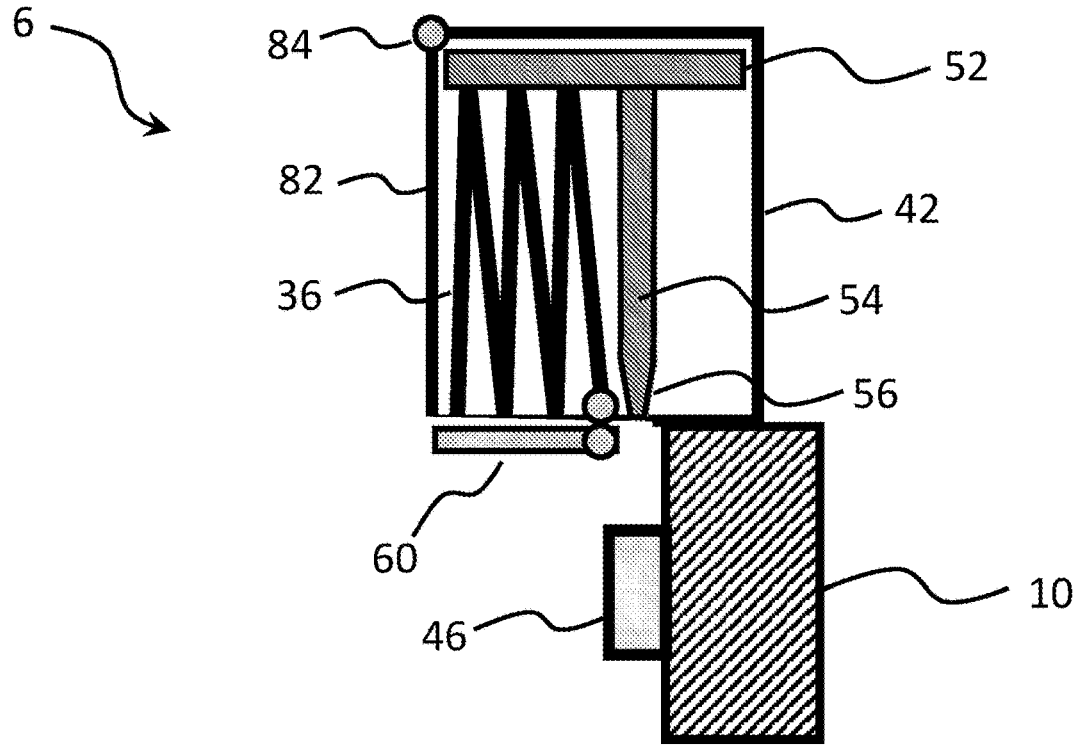
FIG. 16A shows a schematic side elevation cut-away view of an Active Shooter Protection System, according to some embodiments of the present invention, in a fully-packaged configuration.

FIG. 16A shows a schematic side elevation cut-away view of an Active Shooter Protection System 6, according to some embodiments of the present invention, in a fully-packaged configuration. System 6 comprises a box 42 mounted above doorjamb 12, that contains folded-up, pleated ballistic panels 36, 36', 36", etc.; and locking plate 52 with locking bar 54 and tapered tip 56. The bottom of box 42 is covered by bottom support plate 60, which is hinged. When pull-box 20 is activated, bottom support plate 60 is released, which rotates down under gravity, releasing pleated panels 36 to fall out of box 42 under gravity. The outside side panel 82 of box 42 is attached via hinge 84 and can rotate outwards when the ballistic panels 36, 36', 36" are released.

Figure 16B:
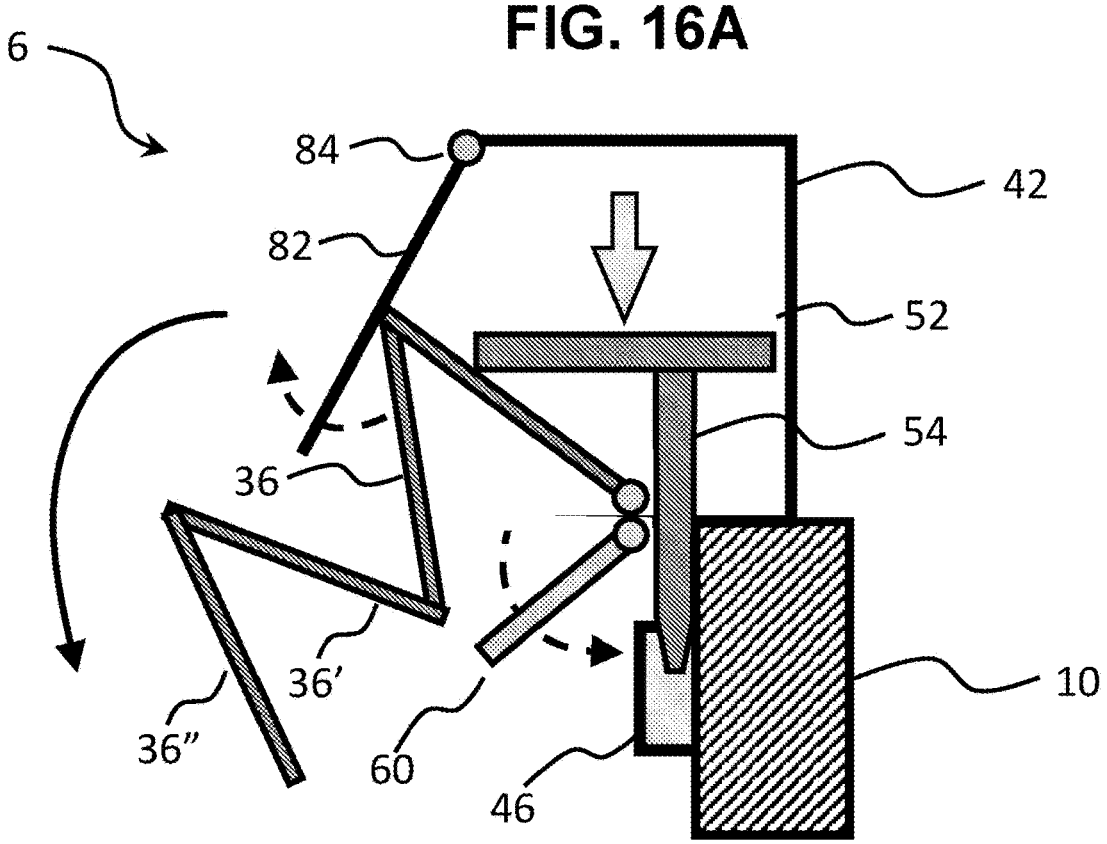
FIG. 16B shows a schematic side elevation cut-away view of an Active Shooter Protection System, according to some embodiments of the present invention, in a partially-deployed configuration.

FIG. 16B shows a schematic side elevation cut-away view of an Active Shooter Protection System 6, according to some embodiments of the present invention, in a partially-deployed configuration, after pleated panels 36, 36', 36", etc. have been released by activating pull box 20. As the pleated panels 36, 36', 36" fall out from box 42, locking plate 52 and locking bar 54 fall down by gravity (which helps to push the accordion-folded pleated panels 36, 36', 36" out of box 42 through an opening in the bottom of box 42), whereon the tapered tip 56 of bar 54 engages locking bracket 46 attached to the top of door 10. The outside side panel 82 of box 42 is attached via hinge 84 has rotated outwards when the ballistic panels 36, 36', 36" are released.

Figure 16C:
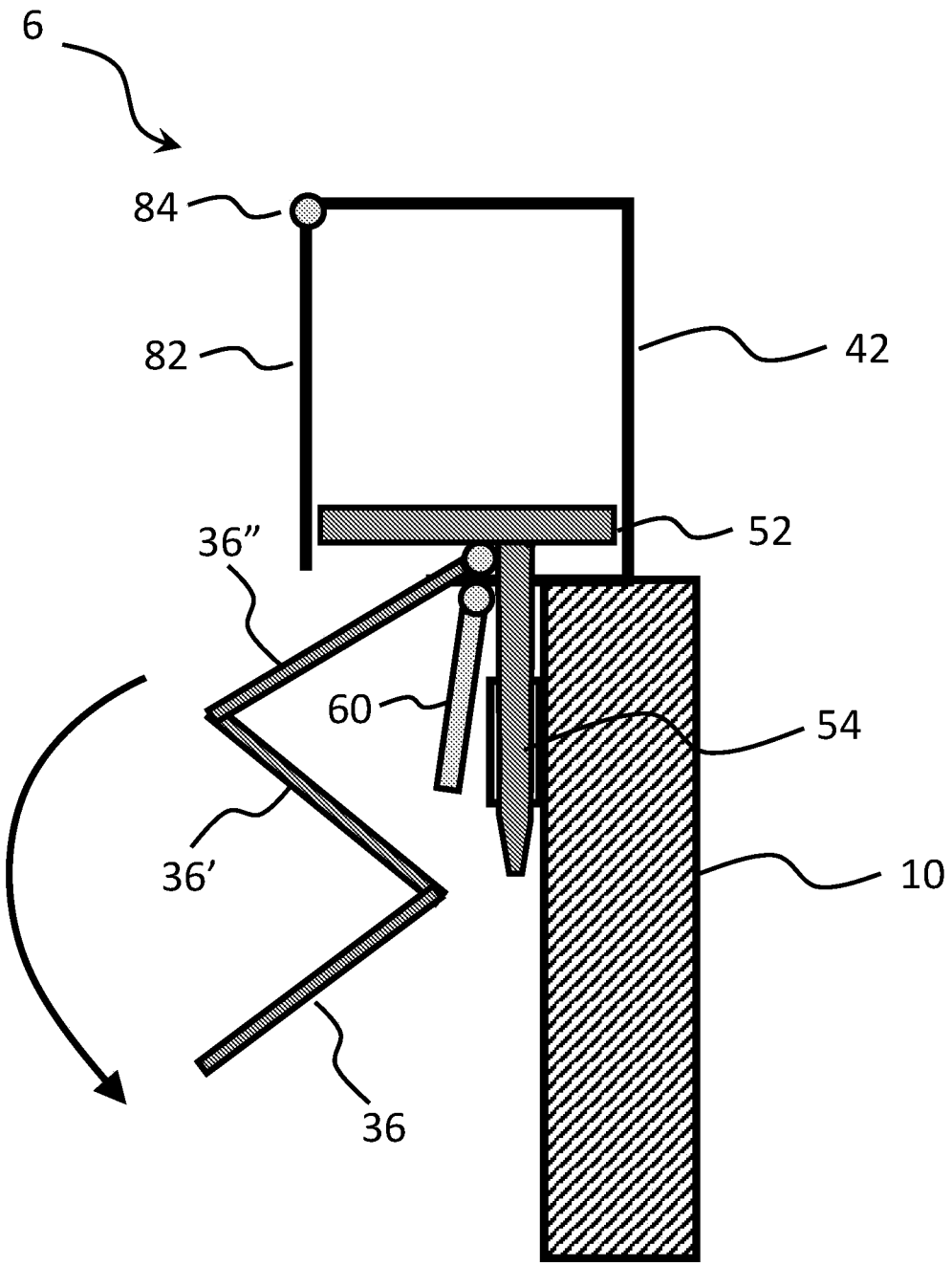
FIG. 16C shows a schematic side elevation cut-away view of an Active Shooter Protection System, according to some embodiments of the present invention, in a partially-deployed configuration.

FIG. 16C shows a schematic side elevation cut-away view of an Active Shooter Protection System 6, according to some embodiments of the present invention, in a partially-deployed configuration. Note: not all of the pleated panels 36, 36', 36", etc. are shown for brevity.

Figure 16D:
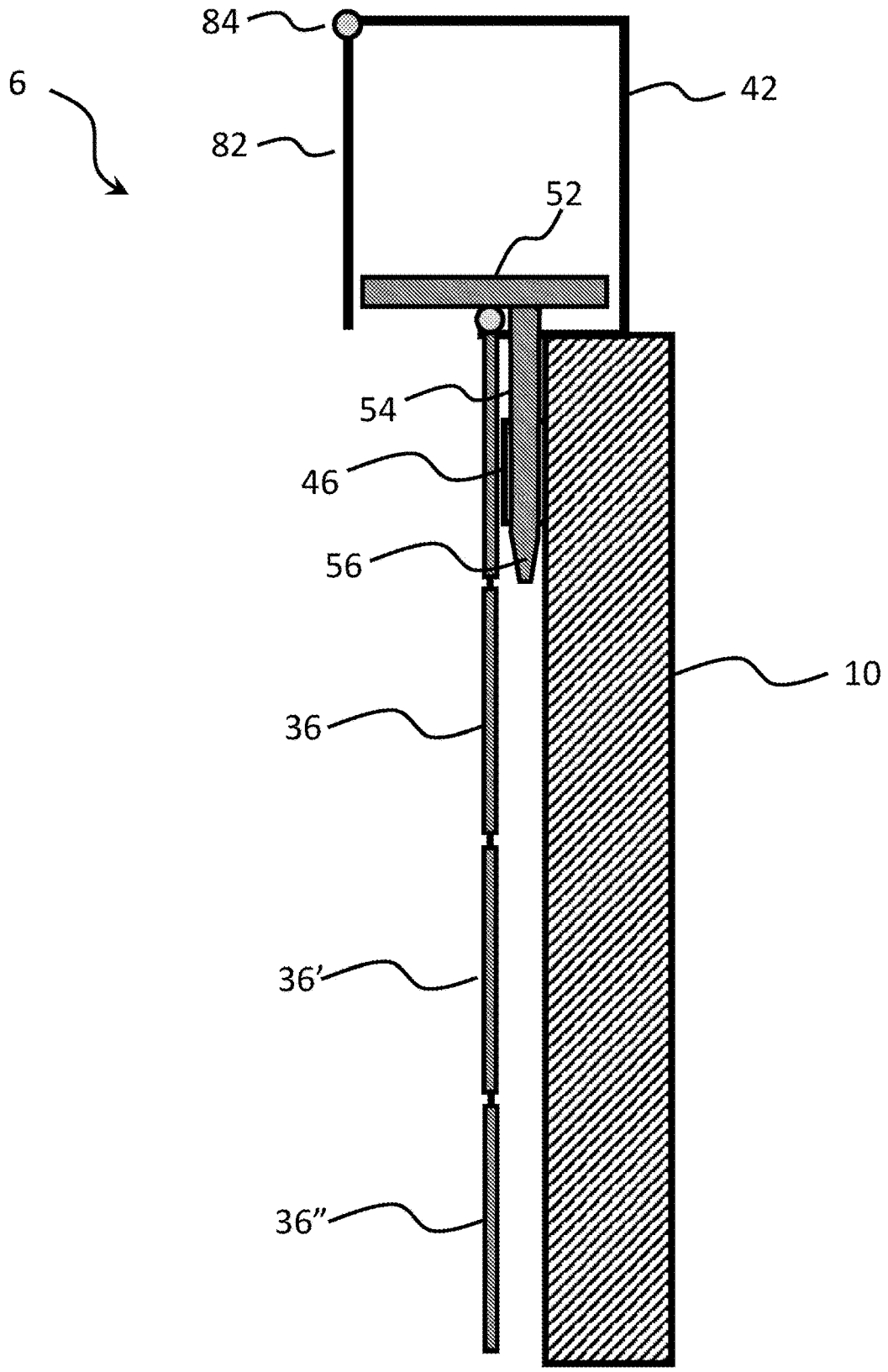
FIG. 16D shows a schematic side elevation cut-away view of an Active Shooter Protection System, according to some embodiments of the present invention, in a fully-deployed and locked configuration.

FIG. 16D shows a schematic side elevation cut-away view of an Active Shooter Protection System 6, according to some embodiments of the present invention, in a fully-deployed and locked configuration.

Figure 17:
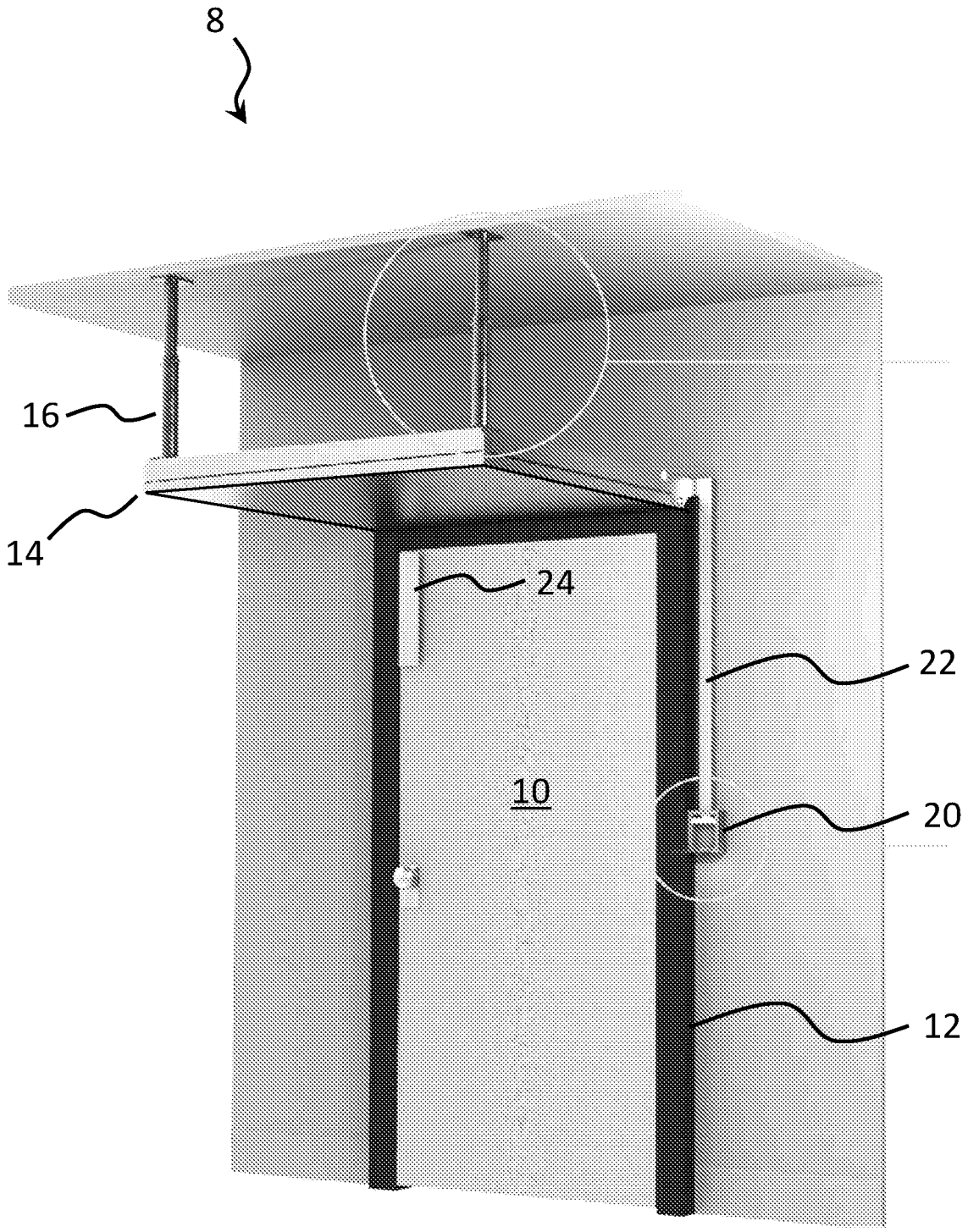
FIG. 17 shows a schematic perspective elevation view of an Active Shooter Protection System, according to some embodiments of the present invention, in a pre-deployed configuration.

FIG. 17 shows a schematic perspective elevation view of an Active Shooter Protection System (ASPS) 8 with a fold-down panel of ballistic cloth (which can't be seen in this view), according to some embodiments of the present invention, in a pre-deployed configuration. ASPS 8 comprises a hinged panel 14 that is held in a horizontal position by a pair of vertical support posts 16, 16' that are attached to the ceiling 15. Door locking plate 24 has deployed and locked the door from opening (in addition to a dead-bolt lock (not shown), if present). System activation (Pull) box 20 is mounted about ½ way up the doorjamb 12 of door 10, and a rod/bar 22 goes from pull-down box 20 connecting to the top corner of horizontal panel 14. A lower position for pull-down box 20 can be used to provide easy wheelchair access.

Figure 18:
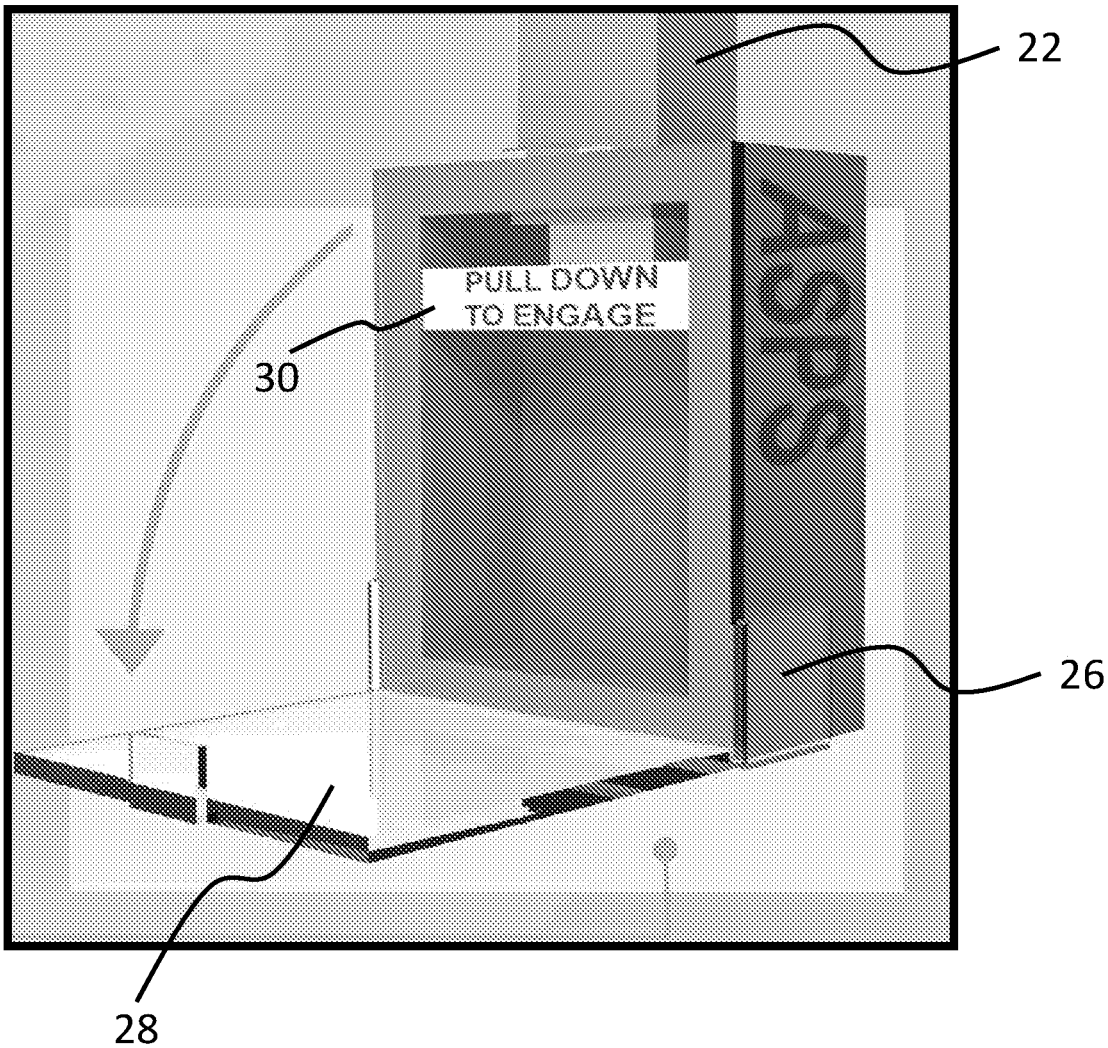
FIG. 18 shows a schematic perspective elevation view of a pull-down box that is used for activating an Active Shooter Protection System, according to some embodiments of the present invention.

FIG. 18 shows a schematic perspective elevation view of a pull-down box 20 that is used for activating an Active Shooter Protection System 8, according to some embodiments of the present invention. Pulling down on the bar marked "PULL" 30 inside of open-faced box 26 activates the ASPS 8 by pulling down vertical rod/bar 22, which releases a pin or activates some other mechanism (not shown) to release the ballistic panels to fall down by gravity. Box 20 can have a transparent plastic or glass cover plate that is hinged on its bottom edge, to deter tampering with the system 8 (much like a fire alarm box).

Figures 19A, 19B, 19C:
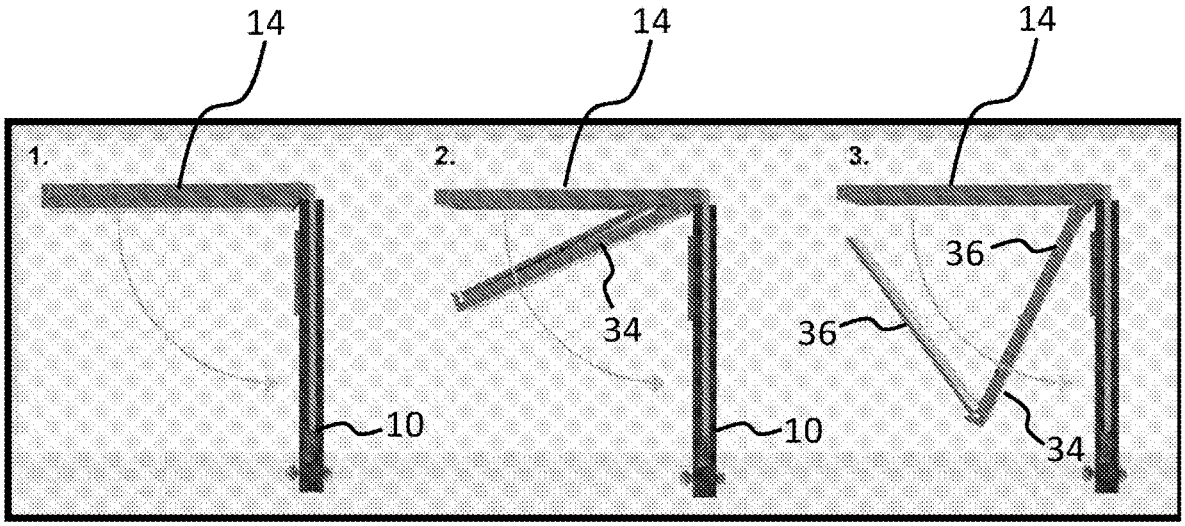
FIG. 19A shows a schematic side elevation elevation view of an Active Shooter Protection System, according to some embodiments of the present invention, in a pre-deployed configuration.
FIG. 19B shows a schematic perspective elevation view of an Active Shooter Protection System, according to some embodiments of the present invention, in a partially-deployed configuration.
FIG. 19C shows a schematic perspective elevation view of an Active Shooter Protection System, according to some embodiments of the present invention, in a partially-deployed configuration.

FIG. 19A shows a schematic side elevation view of an Active Shooter Protection System 8 with a fold-down panel of ballistic cloth 36, according to some embodiments of the present invention. Upper panel 14 is fixed in a horizontal orientation by vertical support post 16.

FIG. 19B shows a schematic side elevation view of an Active Shooter Protection System 8 with a fold-down panel of ballistic cloth 36, in a partially-deployed position, according to some embodiments of the present invention. Upper panel 14 is fixed in a horizontal orientation by vertical support post 16. When pull-box 20 is activated, support panels 34 and 38 are released and both panels rotate down via gravity.

FIG. 19C shows a schematic side elevation view of an Active Shooter Protection System 8 with a fold-down panel of ballistic cloth 36, in a partially-deployed position, according to some embodiments of the present invention. Upper panel 14 is fixed in a horizontal orientation by vertical support post 16. When pull-box 20 is activated, support plate 34 is released and rotates down via gravity, thereby partially exposing ballistic panel 36.

Figure 19D:
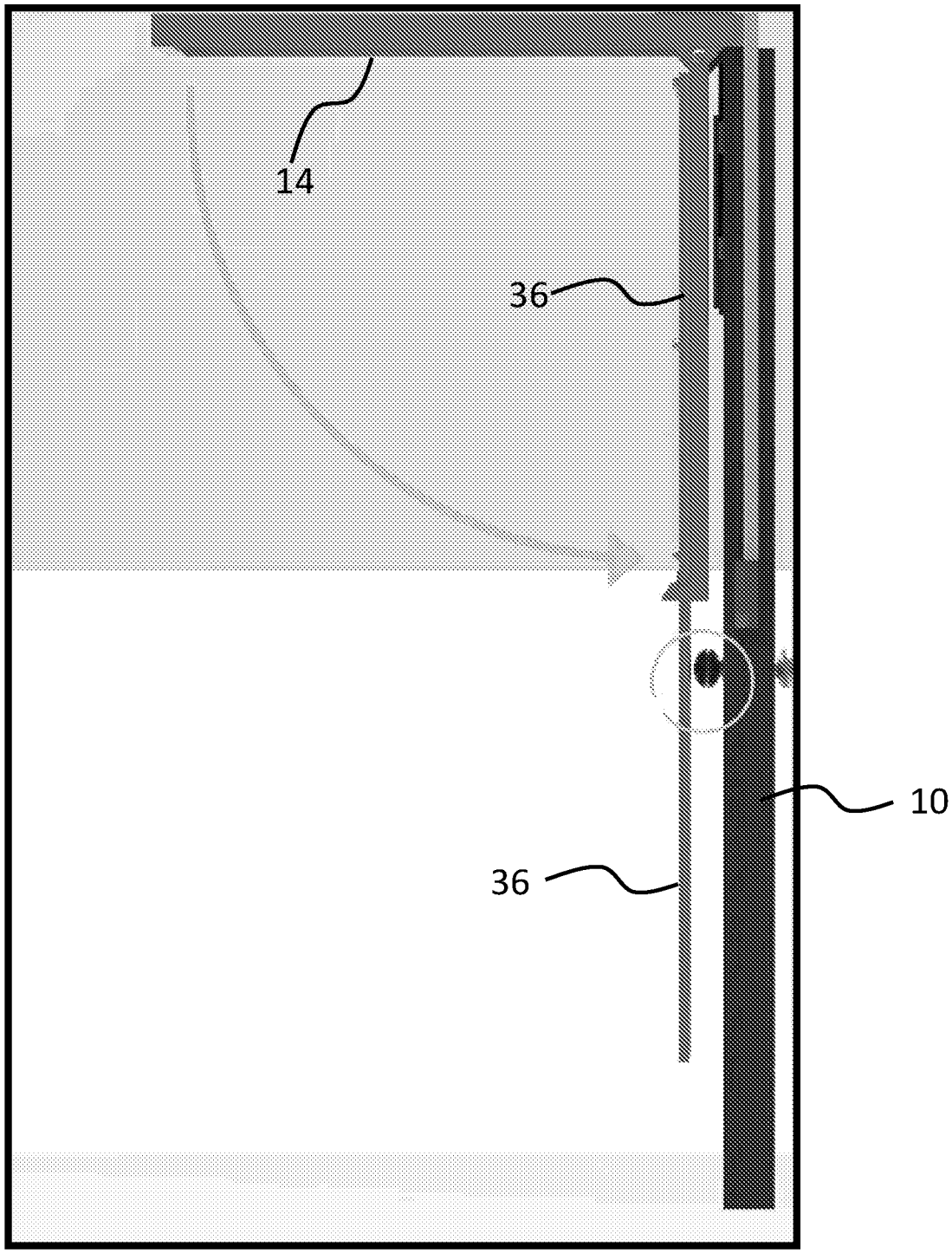
FIG. 19D shows a schematic perspective elevation view of an Active Shooter Protection System, according to some embodiments of the present invention, in a fully-deployed configuration.

FIG. 19D shows a schematic side elevation view of an Active Shooter Protection System 8 with a fold-down panel of ballistic cloth 36, according to some embodiments of the present invention. Upper panel 14 is fixed in a horizontal orientation by vertical support post 16.

Figure 20A:
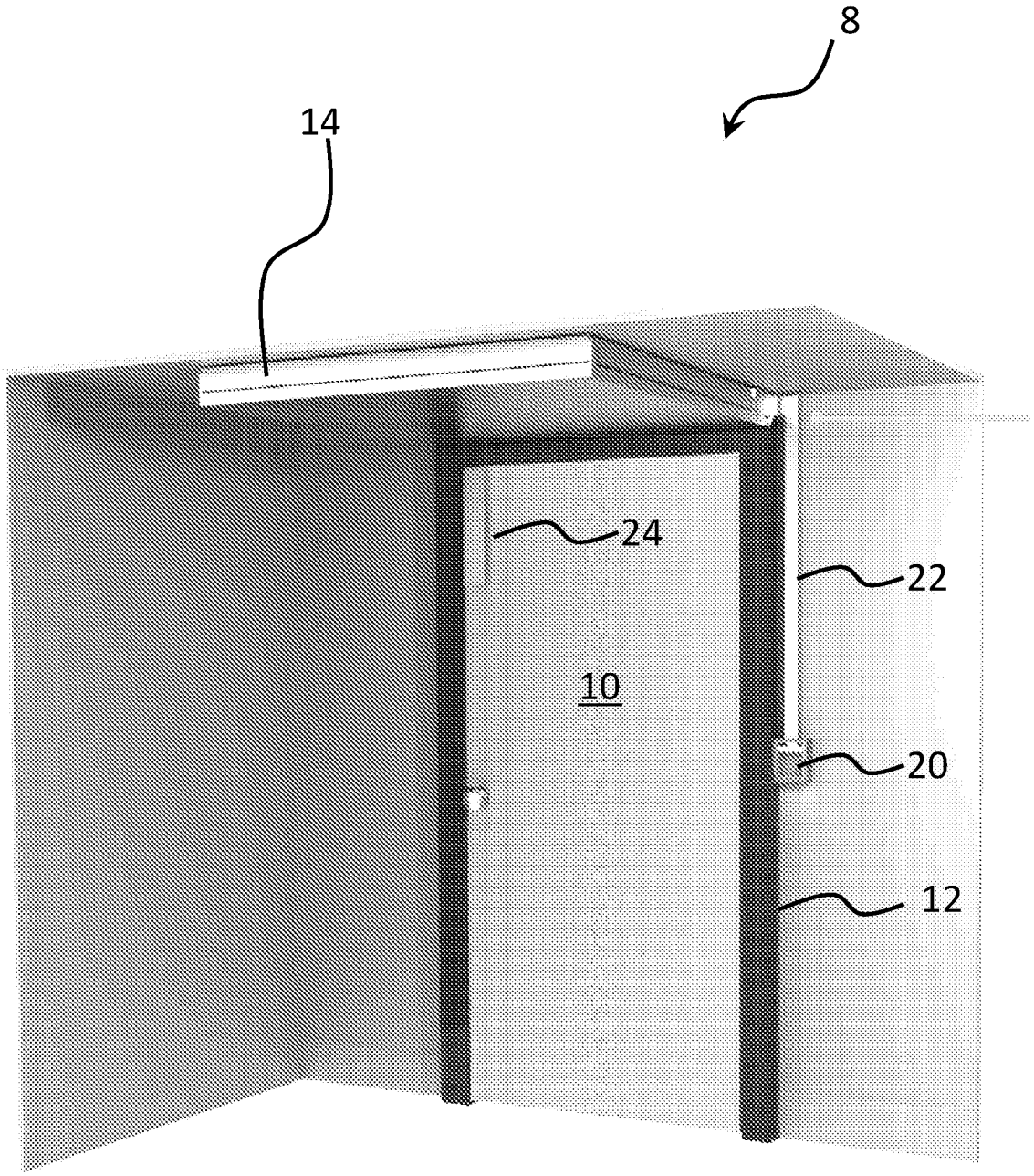
FIG. 20A shows a schematic perspective elevation view of an Active Shooter Protection System, according to some embodiments of the present invention, in a pre-deployed configuration.

FIG. 20A shows a schematic perspective elevation view of an Active Shooter Protection System 8 with a fold-down panel of ballistic cloth (not shown) and with a locking plate 24 in a door-locked position, according to some embodiments of the present invention. Upper support plate 14 is mounted securely to ceiling 15. Pull-box 20 and connecting rod/bar 22 can be seen.

Figure 20B:
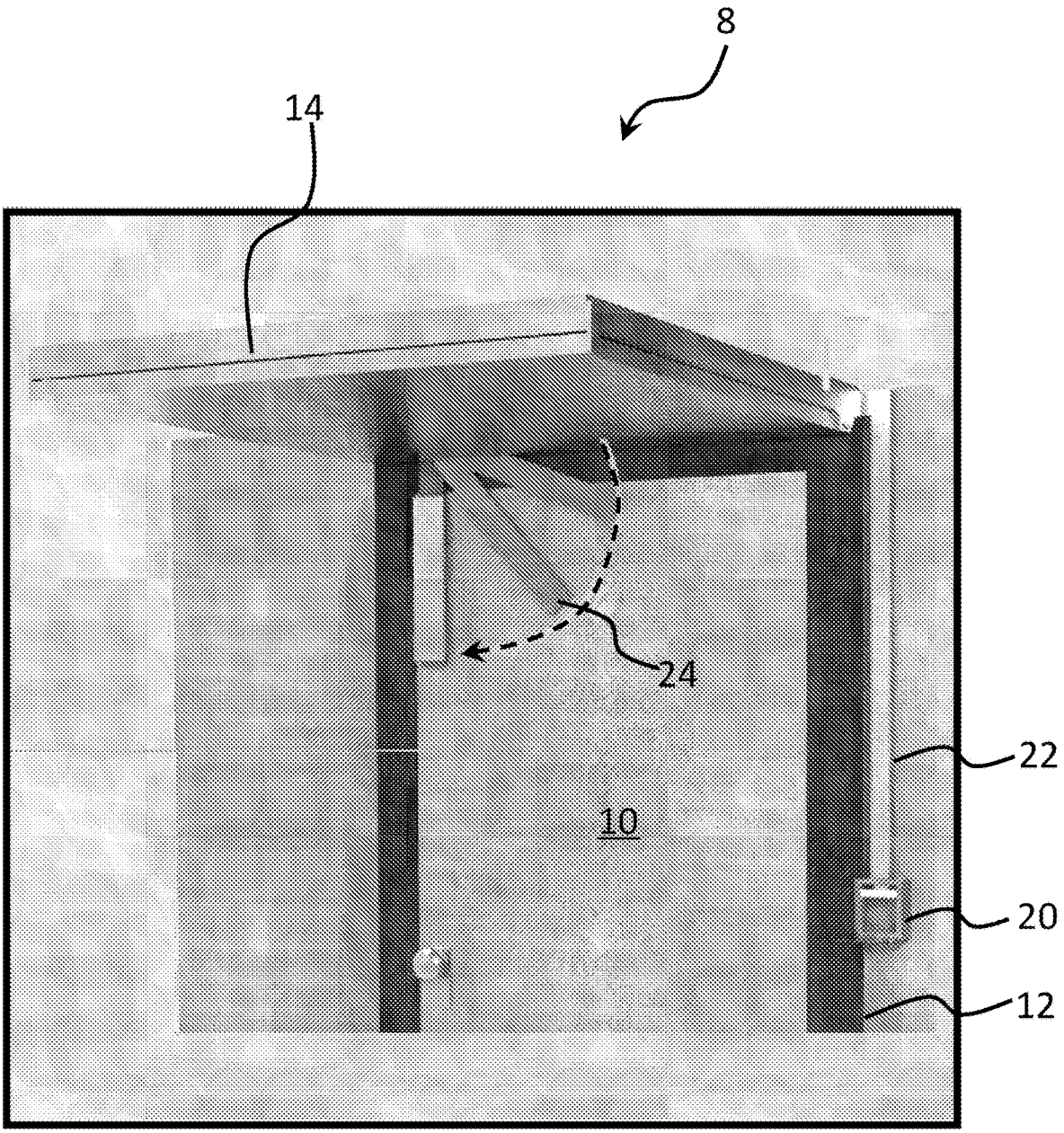
FIG. 20B shows a schematic perspective elevation view of an Active Shooter Protection System, according to some embodiments of the present invention, illustrating a locked-door configuration.

FIG. 20B shows a schematic perspective elevation view of an Active Shooter Protection System 8 with a fold-down panel of ballistic cloth (not shown), illustrating deployment of a locking plate 24 after being released by pull-box 20, according to some embodiments of the present invention.

Figure 20C:
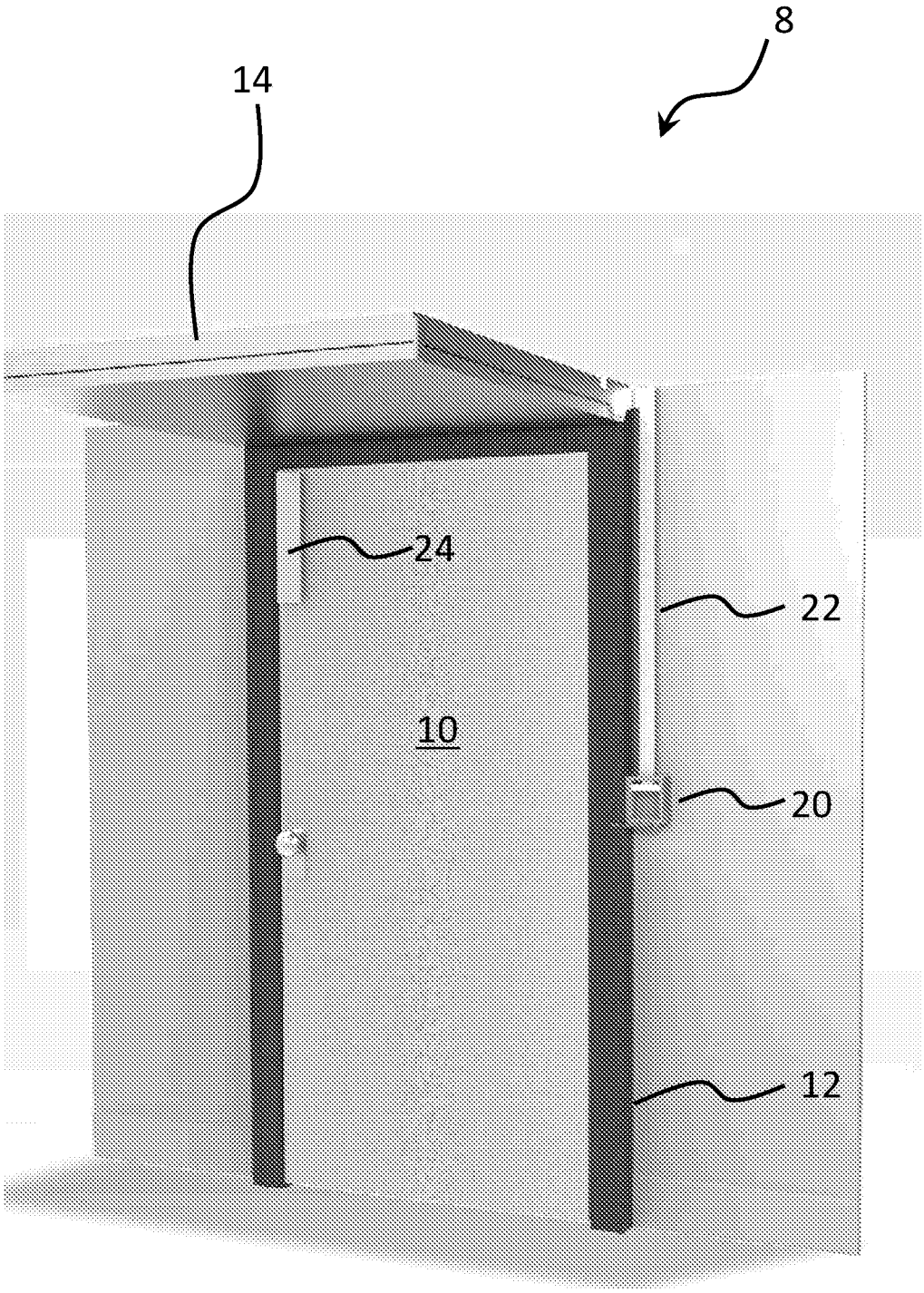
FIG. 20C shows a schematic perspective elevation view of an Active Shooter Protection System, according to some embodiments of the present invention, illustrating a locked-door configuration.

FIG. 20C shows a schematic perspective elevation view of an Active Shooter Protection System 8 with a fold-down panel of ballistic cloth (not shown) and with a locking plate 24 in a door-locked position, according to some embodiments of the present invention. Upper support plate 14 is mounted securely to ceiling 15. Pull-box 20 and connecting rod/bar 22 can be seen.

What is claimed is:

1. An active shooter protection system, comprising:

an upper plate attached to a ceiling near a door to be protected;

a lower plate rotatably coupled to the upper plate with a hinge;

a deployable ballistic blanket comprised of ballistic material folded in half in an initial configuration, with an upper half being attached to the lower plate; and release means for releasing the lower plate from the upper plate, thereby allowing the lower plate to freely rotate downwards under the influence of gravity, wherein the ballistic blanket deploys under gravity and covers the door and thereby stops any bullets from a gun that are fired through the door when the blanket is fully deployed.

2. The active shooter protection system of claim 1, further comprising an integrated locking bar that rotates down into a position that locks the door from opening when the ballistic blanket is deployed.

3. The active shooter protection system of claim 1, further comprising:

a system activation box mounted on a wall near a doorknob of the door, that is mechanically connected to a vertical rod or bar that causes the lower plate to be released when activated.

4. The active shooter protection system of claim 1, further comprising: a handle attached to the lower plate.

5. The active shooter protection system of claim 1, further comprising:

a loop of rope, a Velcro™ strap, or at least one magnet for holding the lower plate up in a position against the upper plate prior to deploying the ballistic blanket.

6. The active shooter protection system of claim 1, wherein the lower plate is made of ⅛"-⅜" steel plate.

7. The active shooter protection system of claim 1, wherein the ballistic material comprises ultra-high-strength fibers selected from the group consisting of: Kevlar™ Spectra Shield™, Dyneema™, Twaron™, UHMWPE (ultra-high molecular weight-polyetheylene) fibers, and graphite fibers, or combinations thereof.

8. The active shooter protection system of claim 1, wherein the ballistic material additionally comprises ceramic, metal, or ceramic/metal composite plates or strips that are mounted inside of the ballistic material for additional ballistic protection.

9. The active shooter protection system of claim 1, wherein the ballistic material additionally comprises graphite fibers woven into a 2-D or 3D form that is impregnated with a curable polymeric resin/activator system to stiffen the panels and make them rigid for additional ballistic protection.

10. The active shooter protection system of claim 1, wherein the system does not require electricity or fuel to operate.

11. An active shooter protection system, comprising:

a box, coupled to a wall above a door to be protected, comprising a hinged lower plate, a set of accordion-folded, pleated, sub-panels made of ballistic material, folded and stored inside of the box in an initial configuration; and a handle for releasing the hinged lower plate of the box, which, upon release, rotates downward, wherein the pleated sub-panels unfold and fall down under gravity, thereby covering the door after the hinged lower plate of the box is released and thereby stop any bullets from a gun that are fired through the door when the sub-panels are fully deployed.

12. An active shooter protection system, comprising:

a box coupled to a wall above a door to be protected, the box comprising a rotatable hinged lower plate;

a set of accordion-folded, pleated sub-panels made of ballistic material, in an initial configuration that are folded and stored inside of the box;

an integrated C-shaped plate, disposed inside of the box near the pleated sub-panels, and comprising one or more elongated locking bars, attached to the plate, and oriented perpendicular to the plate, wherein the one or more elongated locking bars have a distal end that is tapered to fit into a locking bracket;

a pair locking brackets attached to a top of the door, positioned for engaging with the tapered ends of the locking bar, and release means for releasing the rotatable lower plate of the box when activated, and whereupon release and downward rotation of the lower plate causes the ballistic sub-panels to deploy and unfold in a manner that is driven by the locking bar falling downward under gravity, which causes the elongated bars of the locking plate to engage with the locking brackets mounted to the door, thereby securing the door from opening outwards;

whereby the blanket covers the door and stops any bullets from a gun that pass through the door when the blanket is fully deployed.

13. The active shooter protection system of claim 12, wherein the box comprises a side wall that is hinged for rotating the side wall in an outwards direction from an inside of the box during deployment of the ballistic sub-panels.

* * * * *